US008662781B2

(12) United States Patent
Sappenfield

(10) Patent No.: US 8,662,781 B2
(45) Date of Patent: Mar. 4, 2014

(54) CLEANING IMPLEMENTS, CLEANING MATERIAL COMPONENTS, AND RELATED METHODS

(76) Inventor: Christopher C. Sappenfield, San Diego, CA (US)

( * ) Notice: Subject to any disclaimer, the term of this patent is extended or adjusted under 35 U.S.C. 154(b) by 403 days.

(21) Appl. No.: 13/072,656

(22) Filed: Mar. 25, 2011

(65) Prior Publication Data

US 2011/0232013 A1 Sep. 29, 2011

Related U.S. Application Data

(60) Provisional application No. 61/317,746, filed on Mar. 26, 2010.

(51) Int. Cl.
*A47L 13/11* (2006.01)
*B05C 17/00* (2006.01)
*B05C 17/02* (2006.01)

(52) U.S. Cl.
USPC ..... 401/270; 401/21; 401/208; 401/268; 15/228; 15/231

(58) Field of Classification Search
USPC ..... 401/21, 22, 27, 137, 138, 139
See application file for complete search history.

(56) References Cited

U.S. PATENT DOCUMENTS 1,130,064 A * 3/1915 Buchanan ..... 15/228
4,106,153 A * 8/1978 Lemelson ..... 15/231
5,092,699 A * 3/1992 Silvenis ..... 401/21
5,542,143 A * 8/1996 Jem-Yuan ..... 15/119.1
6,098,239 A * 8/2000 Vosbikian ..... 15/228
6,859,976 B2 * 3/2005 Plankenhorn ..... 15/380
7,096,531 B2 8/2006 Policicchio
7,144,173 B2 * 12/2006 Policicchio et al. ..... 401/138
7,571,511 B2 8/2009 Jones et al.
7,620,476 B2 11/2009 Morse et al.
7,636,982 B2 12/2009 Jones et al.
7,761,954 B2 7/2010 Ziegler et al.
7,832,048 B2 * 11/2010 Harwig et al. ..... 15/320
8,464,386 B2 * 6/2013 Garcia ..... 15/99
2003/0044569 A1 3/2003 Kacher et al.
2007/0231046 A1 * 10/2007 Whiffen et al. ..... 401/1
2009/0281661 A1 11/2009 Dooley et al.
2009/0306822 A1 * 12/2009 Augenbraun et al. ..... 700/245

* cited by examiner

*Primary Examiner* — David Walczak
*Assistant Examiner* — Joshua Wiljanen
(74) *Attorney, Agent, or Firm* — Christopher C. Sappenfield

(57) ABSTRACT

The invention provides cleaning implements that include head components comprising cleaning surface components and cleaning material support components. The cleaning material support components typically include cleaning material receiving areas that communicate with the cleaning surface components. Cleaning material receiving areas are generally configured to receive cleaning materials that are movable to and/or from the cleaning material receiving areas to extend over at least portions of the cleaning surface components. The invention also provides cleaning material components that include cleaning material support structures and cleaning materials. Related methods are also provided.

67 Claims, 30 Drawing Sheets

Figure 2L
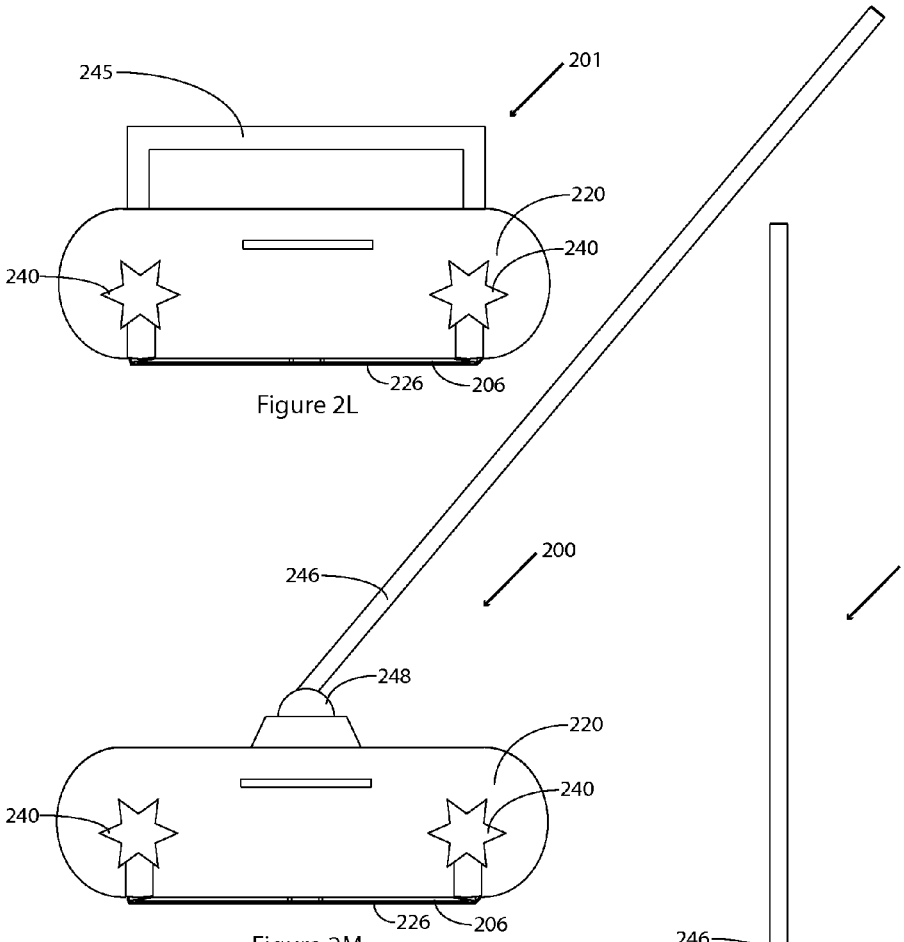
Figure 2M
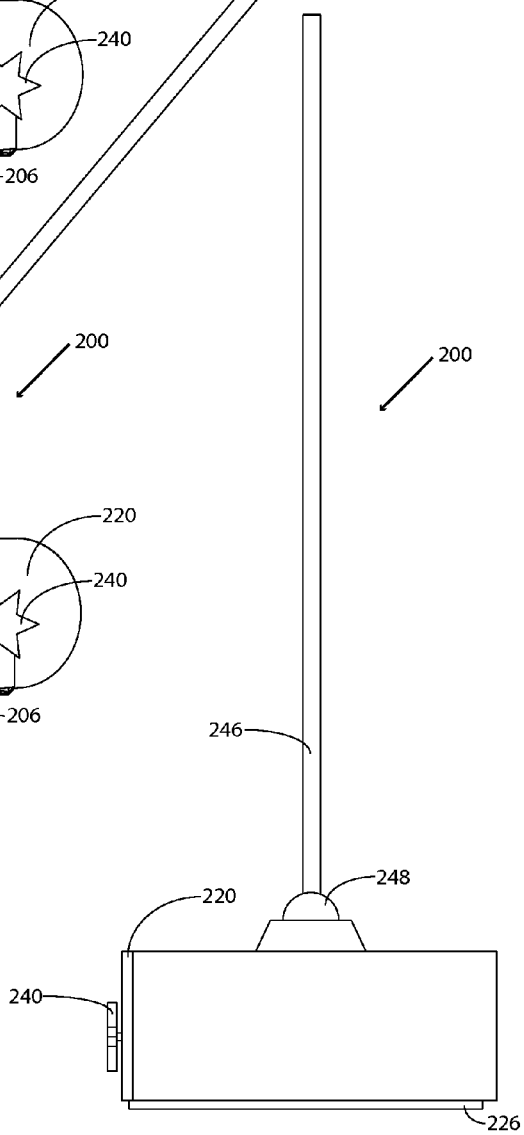
Figure 2N

CLEANING IMPLEMENTS, CLEANING MATERIAL COMPONENTS, AND RELATED METHODS

CROSS-REFERENCE TO RELATED APPLICATIONS

This application claims the benefit of U.S. Provisional Application No. 61/317,746, filed Mar. 26, 2010, which is incorporated by reference herein in its entirety.

FIELD OF THE INVENTION

The invention relates generally to implements and related aspects suitable for cleaning or removing one or more substances from surfaces.

BACKGROUND OF THE INVENTION

The existence of sanitary conditions or surroundings is often essential to maintaining good health or otherwise avoiding illness. Sanitary conditions are frequently established or maintained with the cleaning or removal of undesired substances from the surfaces of objects, such as floors, countertops, tables, sinks, and walls, among numerous other examples. Accordingly, additional cleaning implements or devices, cleaning material components and related aspects are desirable.

SUMMARY OF THE INVENTION

The invention relates to cleaning implements, cleaning material components (e.g., cleaning implement cartridges, etc.), and related components that are suitable for a wide variety of cleaning applications. In some embodiments, for example, cleaning implements include head components that include cleaning material support components and cleaning surface components. Cleaning material support components typically include one or more cleaning material receiving areas that communicate with the cleaning surface components. Cleaning material receiving areas are generally configured to receive cleaning materials such that the cleaning materials are movable to and/or from the cleaning material receiving areas to extend over at least a portion of the cleaning surface components when the cleaning materials are at least partially disposed in the cleaning material receiving areas. Cleaning implements are typically used for various cleaning applications when cleaning materials extend over at least a portion of the cleaning surface components. Many different cleaning materials are optionally adapted for use with the cleaning implements of the invention. Exemplary cleaning materials or cleaning material configurations that are optionally adapted for use with the cleaning implements of the invention, include cleaning material components, individual cleaning sheets, stacks of cleaning sheets, rolls of cleaning materials, cleaning implement cartridges (e.g., including rolls of cleaning materials, etc.), and like. Methods of cleaning surfaces with the cleaning implements of the invention are also provided.

In one aspect, the invention provides cleaning implements that include at least one head component that comprises at least one cleaning surface component and at least one cleaning material support component that comprises a cleaning material receiving area that communicates with the cleaning surface component. The cleaning material receiving area is configured to receive at least one cleaning material such that at least a portion of the cleaning material is movable to and/or from the cleaning material receiving area to extend over at least a portion of the cleaning surface component when the cleaning material is at least partially disposed in the cleaning material receiving area. In some embodiments, cleaning implements include an operably connected robot body structure that is configured to, e.g., effect autonomous operation of the cleaning implements.

In some embodiments, the cleaning implement includes at least one positioning mechanism component that is configured to selectively position the cleaning material at least relative to the cleaning material support component when the cleaning material is at least partially disposed in the cleaning material receiving area. In certain embodiments, the cleaning material receiving area and the cleaning surface component communicate via at least one opening disposed through at least a portion of the cleaning material support component and/or the cleaning surface component. In some embodiments, the cleaning material receiving area of the cleaning material support component is configured to receive a cleaning material component that comprises at least one cleaning material support structure and at least one cleaning material, which cleaning material support structure is structured to support the cleaning material such that the cleaning material is movable to and/or from the cleaning material support structure to extend over at least the portion of the cleaning surface component. In certain embodiments, the cleaning implement includes at least one retaining component that is configured to substantially retain the cleaning material at a selected position relative to the cleaning material support component when the cleaning material is at least partially disposed in the cleaning material receiving area. In some embodiments, the cleaning implement includes at least one retaining mechanism that is configured to substantially retain the cleaning material at a selected position relative to the cleaning surface component when the cleaning material is at least partially disposed in the cleaning material receiving area and the cleaning material extends over at least the portion of the cleaning surface component. In certain embodiments, the cleaning implement includes the cleaning material at least partially disposed in the cleaning material receiving area of the cleaning material support component. In some embodiments, the cleaning surface component comprises at least one elevational element.

In some embodiments, the cleaning implement includes at least one handle operably connected to the head component. In some of these embodiments, the handle is pivotally connected to the head component via at least one pivot mechanism.

In certain embodiments, the cleaning implement includes at least one conveyance mechanism, or at least one component thereof, that is configured to convey at least the cleaning material to extend over at least the portion of the cleaning surface component when the cleaning material is at least partially disposed in the cleaning material receiving area. In some embodiments, the conveyance mechanism is manually operated via at least one manual conveyance component. In certain embodiments, the conveyance mechanism is configured to convey the cleaning material at least one selected incremental distance (e.g., a length of at least a portion of the cleaning surface component, etc.). In some embodiments, the conveyance mechanism comprises one or more gear components. In certain embodiments, the conveyance mechanism comprises at least one motor component that is configured to effect conveyance of the cleaning material when the cleaning material is at least partially disposed in the cleaning material receiving area.

In some embodiments, the cleaning implement includes at least one fluid handling mechanism or at least one component thereof that is configured to convey at least one fluid at least from at least one fluid source to at least one fluid outlet. Typically, the fluid source and fluid outlet communicate via at least one fluid conduit. In some embodiments, the fluid outlet communicates with the cleaning material when the cleaning material is at least partially disposed in the cleaning material receiving area. In certain embodiments, the fluid outlet is disposed proximal to at least one surface of the head component. Optionally, the fluid outlet comprises at least one nozzle. In some embodiments, the fluid handling mechanism comprises at least one pumping mechanism that is configured to pump the fluid from the fluid source to the fluid outlet. In certain embodiments, the fluid handling mechanism comprises at least one vaporization component that is configured to vaporize the fluid at least proximal to the fluid outlet. In some embodiments, the fluid source comprises at least one fluid container. In some of these embodiments, the fluid container is removable, e.g., from the other components of the cleaning implement.

In another aspect, the invention relates to a cleaning implement that includes at least one head component that comprises at least one cleaning material support component and at least one cleaning surface component. The cleaning material support component comprises at least one cleaning material support component surface that at least partially defines at least one cleaning implement cartridge receiving area. The cleaning material support component comprises at least one opening such that the cleaning implement cartridge receiving area communicates with the cleaning surface component. In addition, the cleaning implement cartridge receiving area is configured to receive at least one cleaning implement cartridge comprising cleaning material such that at least a portion of the cleaning material is movable to and/or from the cleaning implement cartridge receiving area to extend over at least a portion of the cleaning surface component when the cleaning implement cartridge is at least partially disposed in the cleaning implement cartridge receiving area. In some embodiments, the cleaning implement cartridge is at least partially disposed in the cleaning implement cartridge receiving area of the cleaning material support component. In some embodiments, cleaning implements include an operably connected robot body structure that is configured to, e.g., effect autonomous operation of the cleaning implements.

In some embodiments, the cleaning implement includes at least one positioning mechanism component that is configured to selectively position the cleaning material at least relative to the cleaning material support component when the cleaning implement cartridge is at least partially disposed in the cleaning implement cartridge receiving area. In certain embodiments, the cleaning implement includes at least two cleaning material support components that are each configured to receive at least a component of the cleaning implement cartridge. Optionally, the cleaning implement includes at least one retaining component that is configured to substantially retain the cleaning implement cartridge at a selected position relative to the cleaning material support component when the cleaning implement cartridge is at least partially disposed in the cleaning implement cartridge receiving area. In some embodiments, the cleaning implement includes at least one retaining mechanism that is configured to substantially retain the cleaning material at a selected position relative to the cleaning surface component when the cleaning implement cartridge is at least partially disposed in the cleaning implement cartridge receiving area and the cleaning material extends over at least the portion of the cleaning surface component. In some embodiments, the cleaning surface component comprises at least one elevational element.

In some embodiments, the cleaning implement includes at least one handle operably connected to the head component. In some of these embodiments, the handle is pivotally connected to the head component via at least one pivot mechanism.

In certain embodiments, the cleaning implement includes at least one conveyance mechanism, or at least one component thereof, that is configured to convey at least the cleaning material over at least the portion of the cleaning surface component when the cleaning implement cartridge is at least partially disposed in the cleaning implement cartridge receiving area. In some of these embodiments, the conveyance mechanism is manually operated via at least one manual conveyance component. In some embodiments, the conveyance mechanism or the component thereof is configured to operably engage the cleaning implement cartridge to effect conveyance of the cleaning material when the cleaning implement cartridge is at least partially disposed in the cleaning implement cartridge receiving area. In certain embodiments, for example, the conveyance mechanism is configured to convey the cleaning material at least one selected incremental distance. In some embodiments, the conveyance mechanism comprises one or more gear components. In certain embodiments, the conveyance mechanism comprises at least one motor component that is configured to effect conveyance of the cleaning material when the cleaning implement cartridge is at least partially disposed in the cleaning implement cartridge receiving area.

In some embodiments, the cleaning implement includes at least one fluid handling mechanism or at least one component thereof that is configured to convey at least one fluid from at least one fluid source to at least one fluid outlet. In some of these embodiments, the fluid source comprises at least one fluid container. In some embodiments, the fluid container is removable, e.g., from one or more components of the cleaning implement. Optionally, the fluid outlet communicates with the cleaning implement cartridge or a portion thereof when the cleaning implement cartridge is at least partially disposed in the cleaning implement cartridge receiving area. In some embodiments, the fluid outlet is disposed proximal to at least one surface of the head component. In certain embodiments, the fluid outlet comprises at least one nozzle. In some embodiments, the fluid handling mechanism comprises at least one pumping mechanism that is configured to pump the fluid from the fluid source to the fluid outlet. In certain embodiments, the fluid handling mechanism comprises at least one vaporization component that is configured to vaporize the fluid at least proximal to the fluid outlet. Typically, the fluid source and fluid outlet communicate via at least one fluid conduit.

In another aspect, the invention provides a cleaning material component that includes at least one cleaning material support structure and at least one cleaning material. The cleaning material support structure is structured to support the cleaning material such that the cleaning material is movable to and/or from the cleaning material support structure. At least a portion of the cleaning material support structure is configured to be received in a cleaning material receiving area of a cleaning implement. In addition, the cleaning material is configured extend over at least a portion of a cleaning surface component of the cleaning implement when the cleaning material support structure is at least partially disposed in the cleaning material receiving area of the cleaning implement.

In some embodiments, the cleaning material component includes at least one conveyance mechanism or at least one component thereof. In certain embodiments, the cleaning material is moistened with at least one fluid. In some embodiments, the cleaning material component includes at least two cleaning material support structures in which the cleaning material communicates with both cleaning material support structures. In some embodiments, the cleaning material component includes at least one positioning mechanism component that is configured to selectively position the cleaning material relative to the cleaning material support structure and/or the cleaning implement. In certain embodiments, the cleaning material support structure and/or the cleaning material comprises at least one alignment component that is configured to align the cleaning material relative to the cleaning material support structure. Typically, the cleaning material comprises at least one absorbent material. In some embodiments, the cleaning material support structure comprises at least one alignment feature that is structured to align the cleaning material support structure relative to a cleaning material support component of the cleaning implement when the cleaning material support structure is at least partially disposed in the cleaning material receiving area of the cleaning implement. In certain embodiments, the cleaning material support structure comprises at least one housing that defines at least one cavity in which at least one orifice is disposed through at least a portion of the housing, and in which the cleaning material is disposed within the cavity and is movable to and/or from the cavity through the orifice.

In certain embodiments, the cleaning material component includes at least one cleaning material sheet. In some embodiments, the cleaning material sheet is substantially continuous. In certain embodiments, the cleaning material sheet is at least partially segmented. In some embodiments, the cleaning material component includes at least one cleaning material roll. In certain embodiments, the cleaning material roll is substantially continuous. In some embodiments, the cleaning material roll is at least partially segmented. In certain embodiments, the cleaning material support structure and/or cleaning material roll comprises at least one alignment component that is configured to align the cleaning material roll relative to the cleaning material support structure. In some embodiments, the alignment component comprises a rod that extends at least partially within the cleaning material support structure (e.g., within a cavity defined by one or more surfaces of the cleaning material support structure). Typically, the rod and/or the cleaning material roll comprises at least one positioning component that is configured to position the rod and the cleaning material roll relative to one another. In some embodiments, the rod extends through at least a portion of the cleaning material support structure and operably connects, or is operably connectable, to at least one conveyance mechanism or at least one component thereof. In certain embodiments, the rod is configured to rotate within the cleaning material support structure. In some embodiments, the cleaning material roll is configured to rotate in a substantially fixed position relative to the rod.

In another aspect, the invention provides a cleaning implement cartridge that includes at least one housing and at least one cleaning material. The housing comprises at least one housing surface that at least partially defines a cavity. The housing also comprises at least one orifice that communicates with the cavity. The cleaning material is at least partially disposed in the cavity such that the cleaning material is movable to and/or from the housing. In addition, at least a portion of the housing is configured to be received in a cleaning implement cartridge receiving area of a cleaning implement. The cleaning material is configured to extend over at least a portion of a cleaning surface component of the cleaning implement when the housing is at least partially disposed in the cleaning implement cartridge receiving area of the cleaning implement.

In some embodiments, the cleaning implement cartridge includes at least one conveyance mechanism or at least one component thereof. In certain embodiments, the cleaning material is moistened with at least one fluid. In some embodiments, the cleaning implement cartridge includes at least one positioning mechanism component that is configured to selectively position the cleaning material relative to the housing and/or the cleaning implement. Typically, the housing and/or the cleaning material comprises at least one alignment component that is configured to align the cleaning material relative to the housing. In some embodiments, the cleaning implement cartridge includes at least two housings in which the cleaning material communicates with both housings. In certain embodiments, the housing comprises at least one alignment feature that is structured to align the housing and the cleaning implement relative to one another when the housing is at least partially disposed in the cleaning implement cartridge receiving area of the cleaning implement.

Typically, the cleaning material comprises at least one absorbent material (e.g., an absorbent sheet, an absorbent pad, or the like). In some embodiments, the cleaning material comprises at least one cleaning material sheet. In certain embodiments, the cleaning material sheet is at least partially segmented. In some embodiments, the cleaning material sheet is substantially continuous. In some embodiments, the cleaning material comprises at least one cleaning material roll. In certain embodiments, the cleaning material roll is at least partially segmented. In some embodiments, the cleaning material roll is substantially continuous. Optionally, the housing and/or cleaning material roll comprises at least one alignment component that is configured to align the cleaning material roll relative to the housing. In some of these embodiments, the alignment component comprises a rod that extends at least partially within the cavity. In some embodiments, the rod and/or the cleaning material roll comprises at least one positioning component that is configured to position the rod and the cleaning material roll relative to one another. In certain embodiments, the rod extends through at least a portion of the housing and operably connects, or is operably connectable, to at least one conveyance mechanism or at least one component thereof. In some embodiments, the cleaning material roll is configured to rotate in a substantially fixed position relative to the rod.

In another aspect, the invention relates to a method of cleaning a surface that includes (a) providing at least one cleaning implement that comprises at least one head component that comprises at least one cleaning surface component and at least one cleaning material support component that comprises a cleaning material receiving area that communicates with the cleaning surface component in which at least one cleaning material is at least partially disposed in the cleaning material receiving area and in which the cleaning material is extended over at least a portion of the cleaning surface component. The method also includes (b) contacting the cleaning material extended over the portion of the cleaning surface component with at least one surface such that one or more substances on the surface are transferred to the cleaning material, thereby cleaning the surface. In some embodiments, the method includes positioning the cleaning material to be at least partially disposed in the cleaning material receiving area prior to (a). In certain embodiments, the method includes extending the cleaning material from the cleaning material support component over at least the portion of the cleaning surface component prior to (a).

BRIEF DESCRIPTION OF THE DRAWINGS

The description provided herein is better understood when read in conjunction with the accompanying drawings which are included by way of example and not by way of limitation. It will be understood that like reference numerals identify like components throughout the drawings, unless the context indicates otherwise. It will also be understood that some or all of the figures may be schematic representations for purposes of illustration and do not necessarily depict the actual relative sizes or locations of the elements shown.

FIG. 1A schematically illustrates a head component of a cleaning implement from a side view according to one embodiment of the invention. FIG. 1O schematically shows the cleaning implement of FIG. 1N with a handle from a front side view.

FIGS. 2A-2N schematically show a cleaning implement, a cleaning material component, or components thereof from various views according to one embodiment of the invention. FIG. 2A schematically illustrates a head component of a cleaning implement from a side view according to one embodiment of the invention. FIG. 2L schematically shows the head component of a cleaning implement of FIG. 2A with a handle from a side view. FIG. 2M schematically shows the head component of a cleaning implement of FIG. 2A with a handle from a side view. FIG. 2N schematically shows the cleaning implement of FIG. 2M with a handle from a front side view.

FIGS. 3 A-N schematically show a cleaning implement, a cleaning material component, or components thereof from various views according to one exemplary embodiment of the invention.

FIGS. 4 A-P schematically show a cleaning implement, a cleaning material component, or components thereof from various views according to one exemplary embodiment of the invention.

FIGS. 5 A-F schematically show a cleaning implement, a cleaning material component, or components thereof from various views according to one exemplary embodiment of the invention.

FIGS. 6 A and B schematically show a cleaning implement, a cleaning material component, or components thereof from various views according to one exemplary embodiment of the invention.

FIGS. 7 A and B schematically show a robotic cleaning implement from various views according to one exemplary embodiment of the invention.

DETAILED DESCRIPTION

The invention relates to cleaning implements, cleaning material components (e.g., cleaning implement cartridges, rolls of cleaning material, etc.), and related components that are suitable for a wide variety of cleaning applications. In some embodiments, for example, cleaning implements include head components that include cleaning material support components and cleaning surface components. Cleaning material support components typically include one or more cleaning material receiving areas that communicate with the cleaning surface components. Cleaning material receiving areas are generally configured to receive cleaning materials such that the cleaning materials are movable to and/or from the cleaning material receiving areas to extend over at least a portion of the cleaning surface components when the cleaning materials are at least partially disposed in the cleaning material receiving areas. Cleaning implements are typically used for various cleaning applications when cleaning materials extend over at least a portion of the cleaning surface components. Many different cleaning materials are optionally adapted for use with the cleaning implements of the invention. Exemplary cleaning materials or cleaning material configurations that are optionally adapted for use with the cleaning implements of the invention, include cleaning material components, individual cleaning sheets, stacks of cleaning sheets, rolls of cleaning materials, cleaning implement cartridges, and like. Methods of cleaning surfaces with the cleaning implements of the invention are also provided.

Figure 1A:
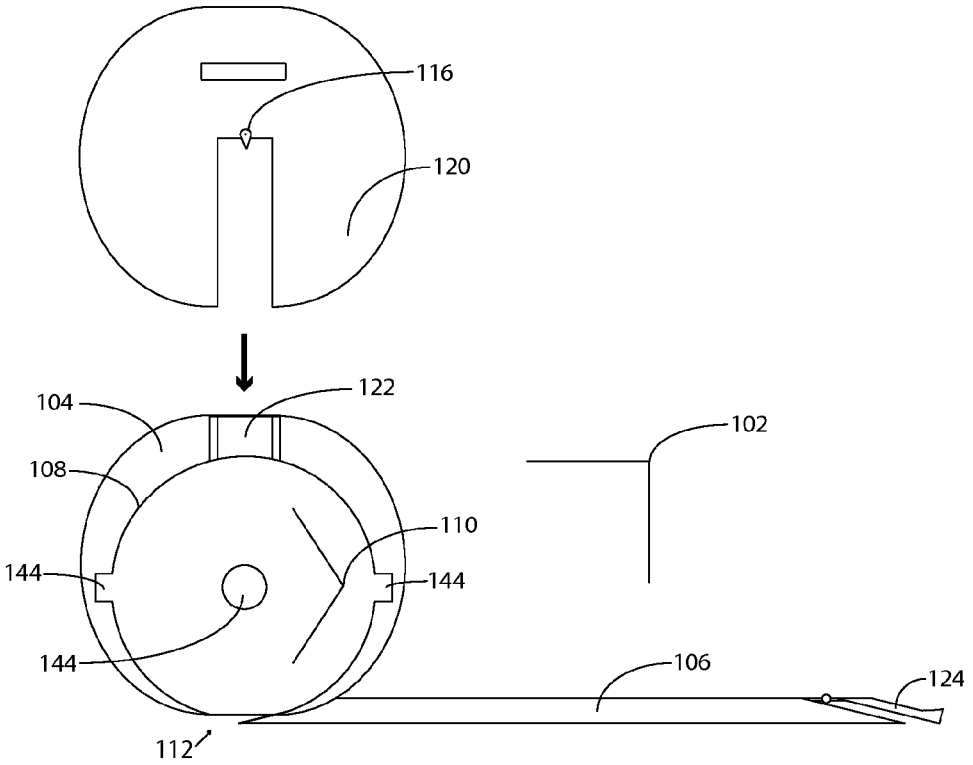
FIGS. 1A-1O schematically show a cleaning implement, a cleaning material component, or components thereof from various views according to one embodiment of the invention.
Figure 1B:
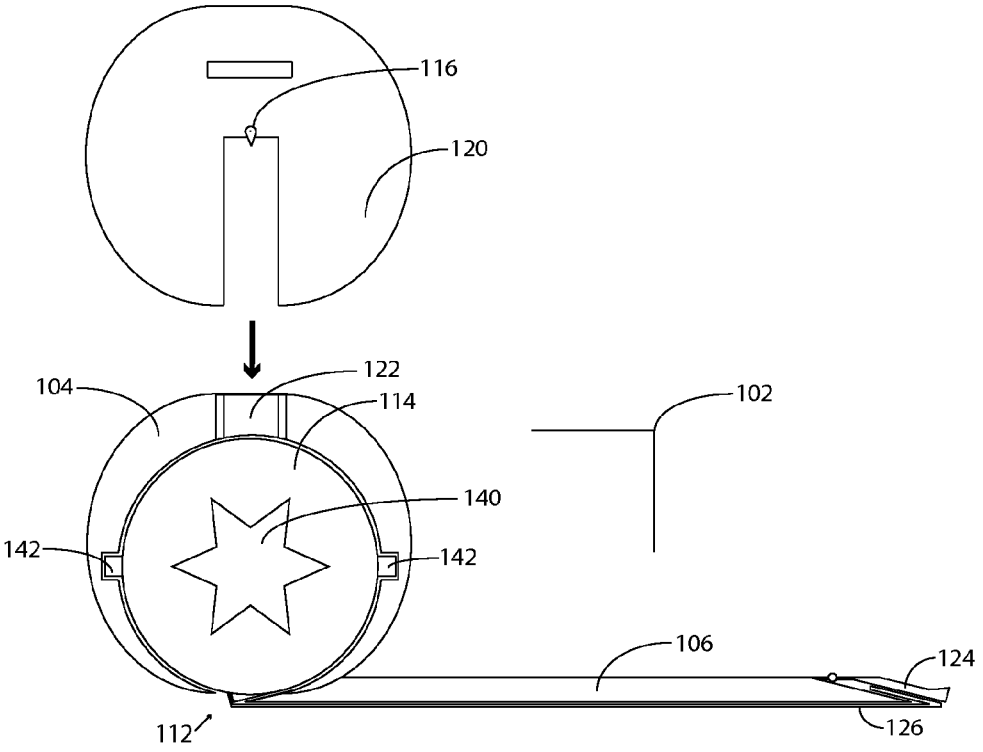
FIG. 1B schematically shows the head component of the cleaning implement of FIG. 1A including a cleaning material component from a side view.
Figure 1C:
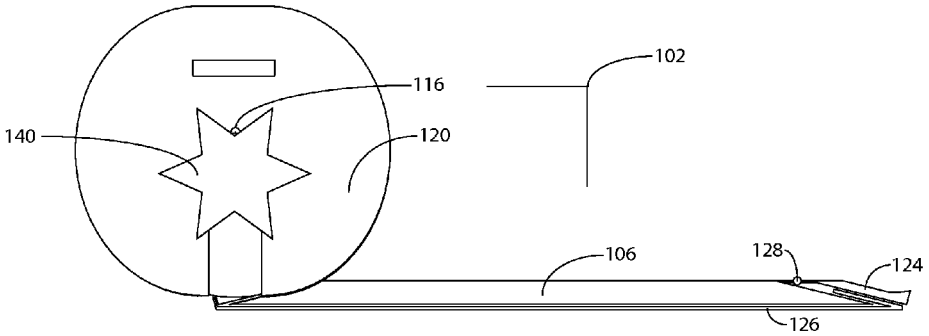
FIG. 1C schematically depicts the cleaning implement of FIG. 1A with an exemplary retaining component in a closed position from a side view.
Figure 1D:
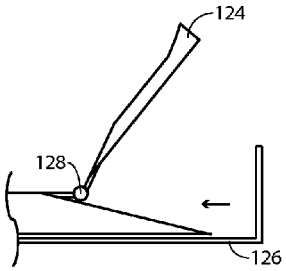
FIG. 1D schematically shows a retaining mechanism of the cleaning implement of FIG. 1A from a detailed side view.
Figure 1E:
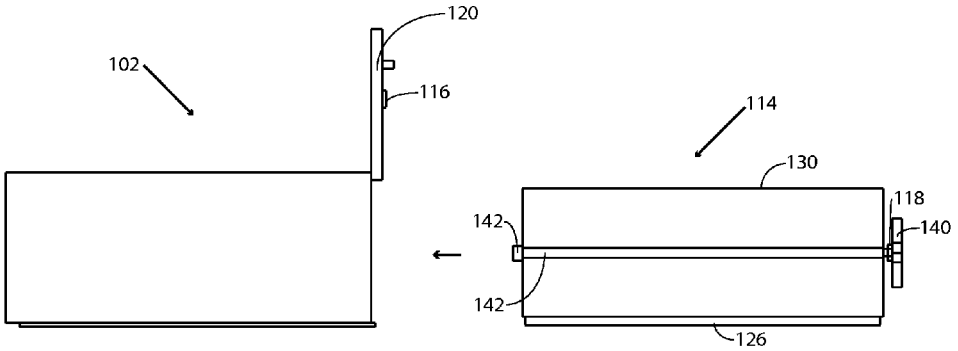
FIG. 1E schematically shows a cleaning material component being inserted into the cleaning material support component of the cleaning implement of FIG. 1A from a side view.
Figure 1F:
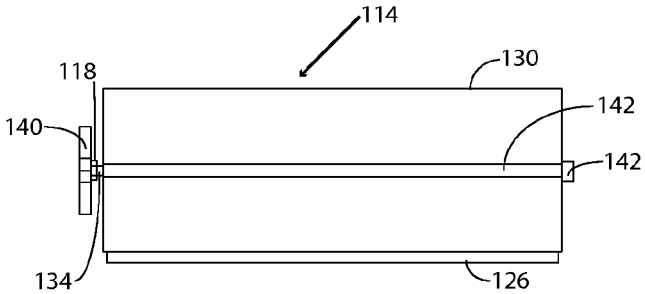
FIG. 1F schematically depicts a cleaning material component of the cleaning implement of FIG. 1A from a side view.
Figure 1G:
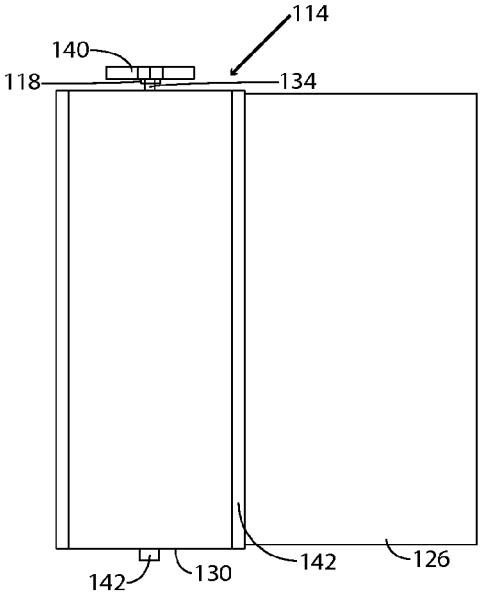
FIG. 1G schematically depicts a cleaning material component of the cleaning implement of FIG. 1A from a top side view.
Figure 1H:
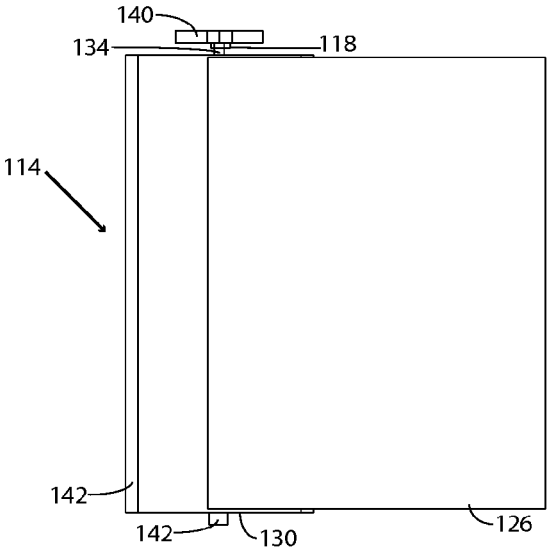
FIG. 1H schematically shows a cleaning material component of the cleaning implement of FIG. 1A from a bottom side view.
Figure 1I:
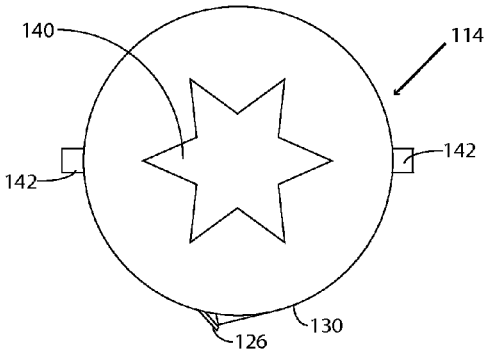
FIG. 1I schematically illustrates a cleaning material component with a manual conveyance component of the cleaning implement of FIG. 1A from a side view.
Figure 1J:
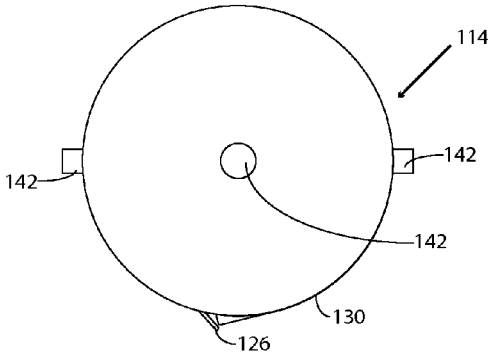
FIG. 1J schematically illustrates a cleaning material component of the cleaning implement of FIG. 1A from a side view.
Figure 1K:
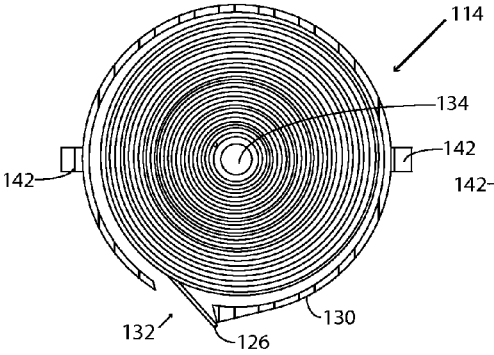
FIG. 1K schematically shows a sectional view of a cleaning material component of the cleaning implement of FIG. 1A.
Figure 1L:
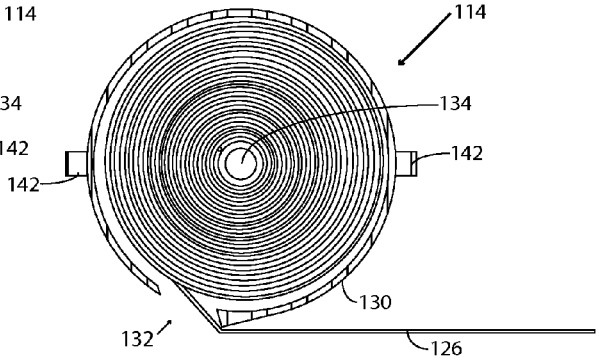
FIG. 1L schematically shows a sectional view of a cleaning material component of the cleaning implement of FIG. 1A with a cleaning material roll partially extended.
Figure 1M:
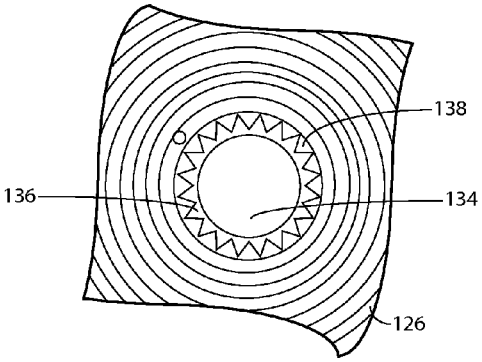
FIG. 1M schematically illustrates a detailed view of a positioning component of a cleaning material component of the cleaning implement of FIG. 1A.
Figure 1N:
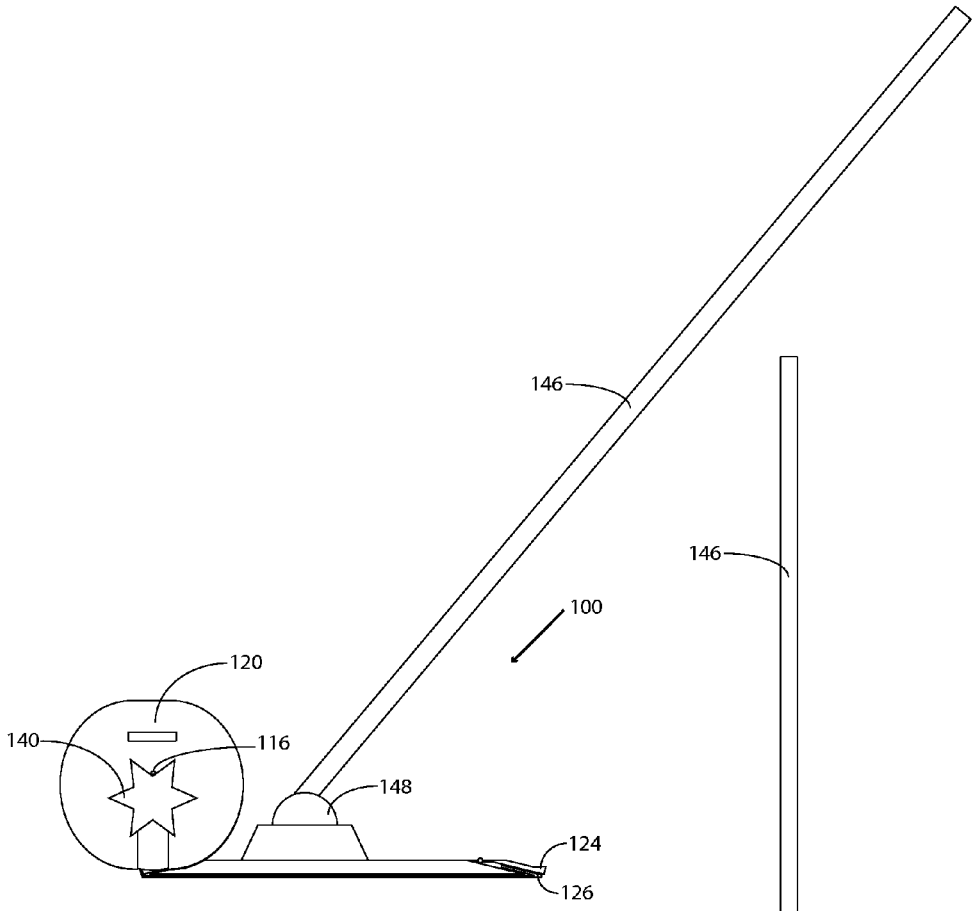
FIG. 1N schematically shows the cleaning implement of FIG. 1A with a handle from a side view.
Figure 1O:
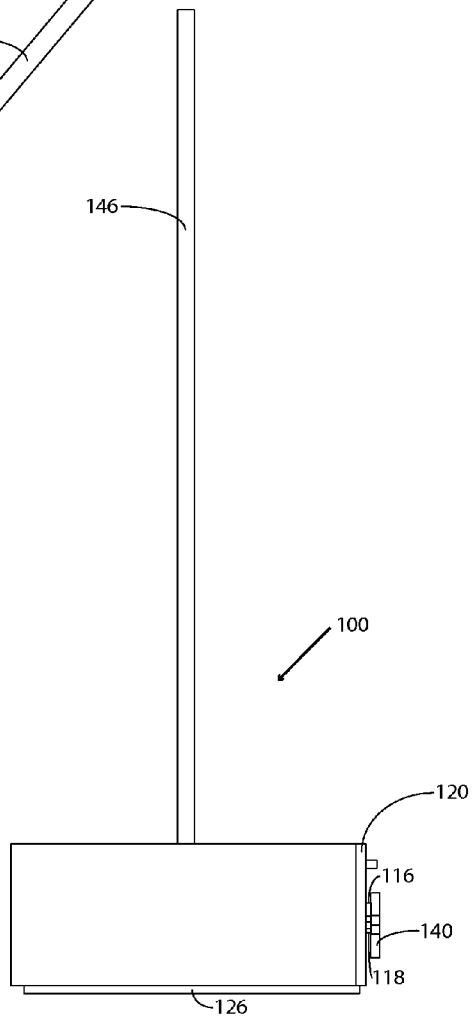

To illustrate, FIGS. 1A-1O schematically show a cleaning implement, a cleaning material component, or components thereof from various views according to one embodiment of the invention. As shown, cleaning implement 100 includes head component 102 which includes cleaning material support component 104 and cleaning surface component 106. Cleaning material support component 104 includes a cleaning material support component surface 108 that at least partially defines at least one cleaning material receiving area 110 (shown as a cleaning implement cartridge receiving area). As also shown, cleaning material support component 104 includes opening 112 that is structured such that cleaning material receiving area 110 communicates with cleaning surface component 106. As used herein, the term "communicate" refers to the direct or indirect transfer or transmission, and/or capability of directly or indirectly transferring or transmitting, something at least from one thing or location to another thing or location. In some embodiments, for example, cleaning materials are transferred from cleaning material receiving areas to extend over or to cover at least portions of cleaning surface components via openings disposed in and/or through cleaning material support components. As shown, cleaning material receiving area 110 is configured to receive cleaning material component 114 (shown as a cleaning implement cartridge that includes a cleaning material roll) such that at least a portion of cleaning material component 114 is movable to and/or from cleaning material receiving area 110 to extend over at least a portion of cleaning surface component 106. In some embodiments, cleaning material receiving areas of cleaning material support components are configured to receive cleaning material components (e.g., cleaning implement cartridges or the like), cleaning materials (e.g., directly placed or positioned at least partially within cleaning material receiving areas in the absence of other parts of cleaning material components, etc.), or the like. Cleaning material components and cleaning materials (e.g., sheets of cleaning material pads, rolls of cleaning material sheets, cleaning material belts, and the like) are described further herein.

As also shown, cleaning implement 100 and cleaning material component 114 include positioning mechanism components (shown as a gear and clip mechanism) 116 and 118, respectively, that are configured to selectively position cleaning material component 114 at least relative to cleaning material support component 104 when cleaning material component 114 is disposed in cleaning material receiving area 110. In the exemplary embodiment shown, the gear and clip mechanism are configured to restrict cleaning material component 114 to unidirectional rotation when cleaning material component 114 is disposed in cleaning material receiving area 110.

In addition, cleaning implement 100 also includes retaining component 120 (shown as a door structure) that operably engages cleaning material support component 104 via slide component 122 in this exemplary embodiment. Essentially any suitable mechanism is optionally used to operably engage cleaning material support components and retaining components with one another in these embodiments, including, for example, clamps, hinges, clips, and the like. Retaining components are generally configured to substantially retain cleaning material components or cleaning materials at least partially within or at selected positions relative to cleaning material support components, for example, during cleaning implement usage.

To further illustrate, cleaning implement 100 also includes retaining mechanism 124 that is configured to substantially retain cleaning material 126 (shown as a rolled sheet of cleaning material (e.g., a roll of a cleaning material, cloth, pad, sponge, or the like)) at a selected position relative to cleaning surface component 106 when cleaning material 126 is at least partially disposed in cleaning material receiving area 110 and cleaning material 126 extends over at least the portion of cleaning surface component 106. In the embodiment shown, retaining mechanism 124 includes spring-loaded hinge component 128 connected to cleaning surface component 106. Spring-loaded hinge component 128 functions to clamp or otherwise retain cleaning material 126 in a selected position when retaining mechanism 124 is in a closed position as shown, for example, in FIG. 1C. Retaining mechanism 124 is schematically illustrated in an open position, for example, in FIG. 1D. Any suitable retaining mechanism is optionally used in the cleaning implements of the invention to hold cleaning materials at selected positions relative to cleaning surface components, for example, so that cleaning materials are held in position for usage. Exemplary retaining mechanisms that are optionally used, include, for example, hook and/or loop fastening components (e.g., VELCRO® or the like), adhesives (e.g., applied to cleaning materials and/or cleaning surface components, etc.), clips, clamps, or the like.

The cleaning materials used in the cleaning implements of the invention include various embodiments. In some embodiments, for example, stacks of folded cleaning material sheets or rolls of cleaning material sheets are received directly (i.e., without cleaning material support structures or the like) in cleaning material receiving areas of the cleaning implements of the invention. In certain embodiments, cleaning material sheets are entirely segmented from one another (e.g., a stack of multiple individual cleaning material sheets, pads (e.g., SWIFTER® pads) or cloths, etc.), partially segmented (e.g., partially perforated or otherwise partially attached to one another at selected intervals) such that individual cleaning material sheets can be readily removed from one another (e.g., following usage), or substantially continuous with one another. In some embodiments, cleaning materials are configured such that multiple sides of the cleaning materials can be used. In some of these embodiments, for example, after a first side of a cleaning material sheet is used, the sheet may be turned over such that a second side of the cleaning material sheet may be used. In certain embodiments, cleaning materials are configured as consumables for use with the cleaning implements of the invention, whereas as in other exemplary embodiments, cleaning implements (including cleaning materials) are intended to be disposable. Optionally, cleaning materials are moistened with fluid (e.g., water, a cleaning solution, vaporized fluid, etc.) prior to and/or during usage. In some embodiments, the cleaning materials used with the cleaning implements of the invention include or a composed of absorbent materials. Exemplary cleaning materials that are optionally adapted for use with the cleaning implements of the invention are also described in, e.g., U.S. Pat. No. 7,096,531, entitled "Cleaning implement for cleaning a surface" which issued Aug. 29, 2006 to Policicchio and U.S. Patent Publication No. 2003/0044569, entitled "Disposable cleaning sheets comprising a plurality of protrusions for removing debris from surfaces" which published Mar. 6, 2003 by Kacher et al., which are both incorporated by reference in their entirety.

In other exemplary embodiments, the cleaning implements of the invention are configured for use with cleaning material components (e.g., cleaning implement cartridges or the like). To illustrate, cleaning material component 114 is used with cleaning implement 100. As shown, cleaning material component 114 includes cleaning material support structure 130 and cleaning material 126 (shown as a rolled sheet of cleaning material). Cleaning material support structure 130 (shown as a substantially cylindrically-shaped housing) forms a cavity that is structured to house and support cleaning material 126 such that cleaning material 126 is movable to and/or from cleaning material support structure 130 via orifice 132. Orifice 132 is configured to communicate with opening 112. Cleaning material support structures and corresponding cleaning material receiving areas are optionally formed to include various cross-sectional shapes, including, e.g., circles, ovals, squares, rectangles, regular n-sided polygons, irregular n-sided polygons, etc. As shown, cleaning material support structure 130 is configured to be received in cleaning material receiving area 110 of cleaning implement 100 and cleaning material 126 is configured to extend over cleaning surface component 106 of cleaning implement 100 via orifice 132 and opening 112.

In some embodiments, cleaning material support structures and/or cleaning materials of cleaning material components include one or more alignment components that are configured to align cleaning materials relative to cleaning material support structures. To illustrate, cleaning material support structure 130 of cleaning material component 114 includes rod 134 that extends within cleaning material support structure 130. As shown, the alignment component (rod 134) of cleaning material support structure 130 inserts into a corresponding central receiving area of the cleaning material roll (cleaning material 126) to align cleaning material 126 relative to cleaning material support structure 130. In some embodiments, cleaning material components include one or more positioning components that are configured to position cleaning materials and cleaning material support structures relative to one another (e.g., in a substantially fixed position). To illustrate, rod 134 and cleaning material roll (cleaning material 126) include corresponding positioning components 136 and 138, respectively (shown as tongue and groove-type components that engage one another), that are configured to substantially fixedly position rod 134 and cleaning material roll (cleaning material 126) relative to one another. As shown, rod 134 and cleaning material roll (cleaning material 126) are configured to rotate within cleaning material support structure 130 in a substantially fixed position relative to one another due to positioning components 136 and 138. In other exemplary embodiments, cleaning material rolls are configured to rotate around or relative to alignment components (e.g., rods or the like).

In certain embodiments, cleaning implements and/or cleaning material components operably connect, or are operably connectable, to conveyance mechanisms or components thereof. In cleaning implement 100, for example, rod 134 extends through cleaning material support structure 130 and operably connects to conveyance mechanism component 140 (shown as a manual conveyance component (e.g., a manually operated handle)). Conveyance mechanism component 140 is configured to rotate cleaning material rolls (cleaning material 126) selected distances such that in conjunction with positioning mechanism components 116 and 118, cleaning material 126 is positioned at selected positions relative to cleaning surface component 106. Other exemplary conveyance mechanisms are described herein or otherwise known to those skilled in the art.

Typically, cleaning material support components of cleaning implements and/or cleaning material components include one or more alignment features that are structured to align those components relative to one another when the cleaning material components are disposed in the cleaning material receiving areas of the cleaning implements. In one exemplary embodiment, for example, cleaning material support structure 130 and cleaning material support component 104 include alignment features 142 and 144, respectively (schematically shown as corresponding tongue and groove-type components or holes and corresponding posts or pegs), that are structured to align cleaning material support structure 130 relative to cleaning material support component 104 cleaning implement 100.

The cleaning implements of the invention typically include one or more handle components. To illustrate, cleaning implement includes handle 146 operably connected to head component 102. Handle 146 is pivotally connected to head component 102 via pivot mechanism 148 (shown as a ball and socket mechanism).

Figure 2A:
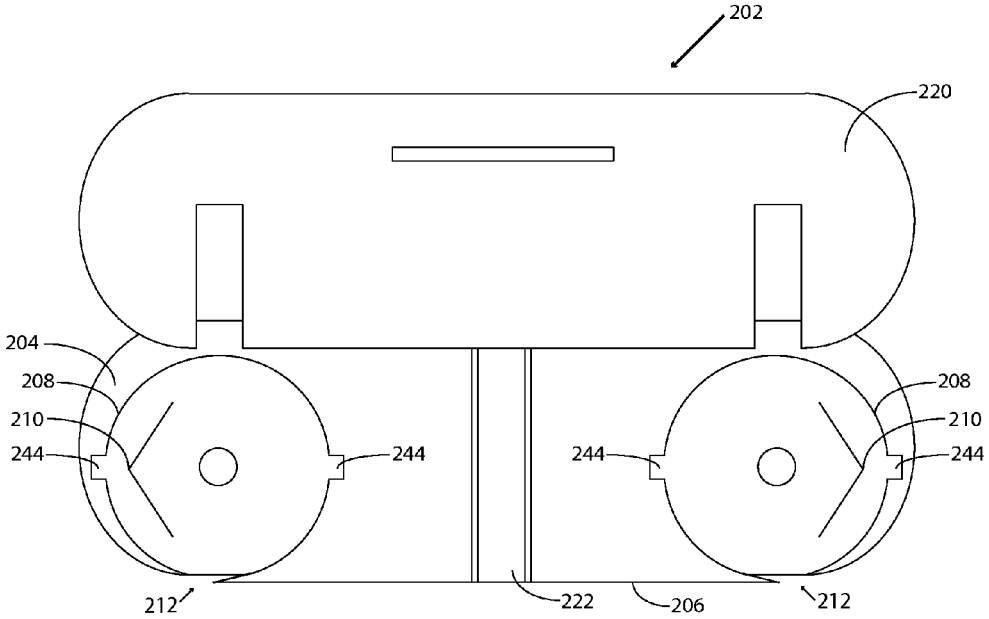
Figure 2B:
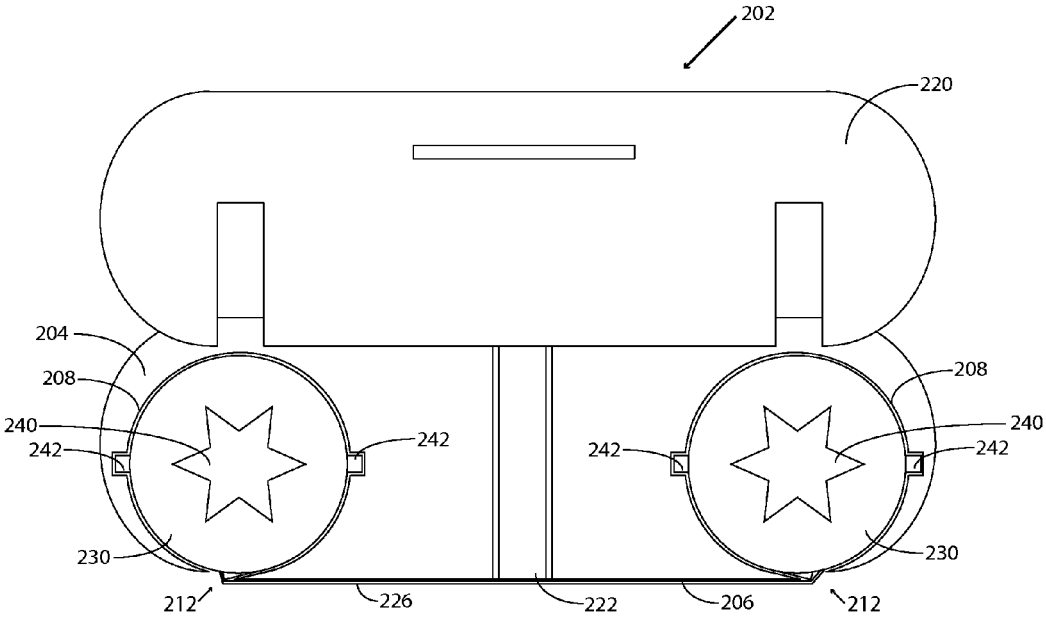
FIG. 2B schematically shows the head component of the cleaning implement of FIG. 2A including a cleaning material component from a side view.
Figure 2C:
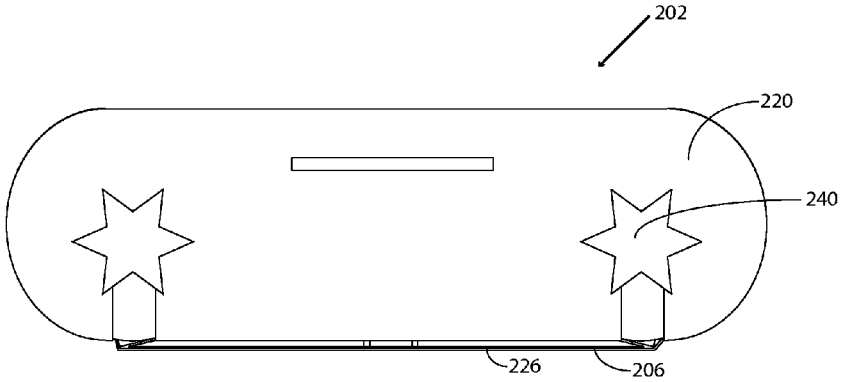
FIG. 2C schematically depicts the cleaning implement of FIG. 2A with an exemplary retaining component in a closed position from a side view.
Figure 2D:
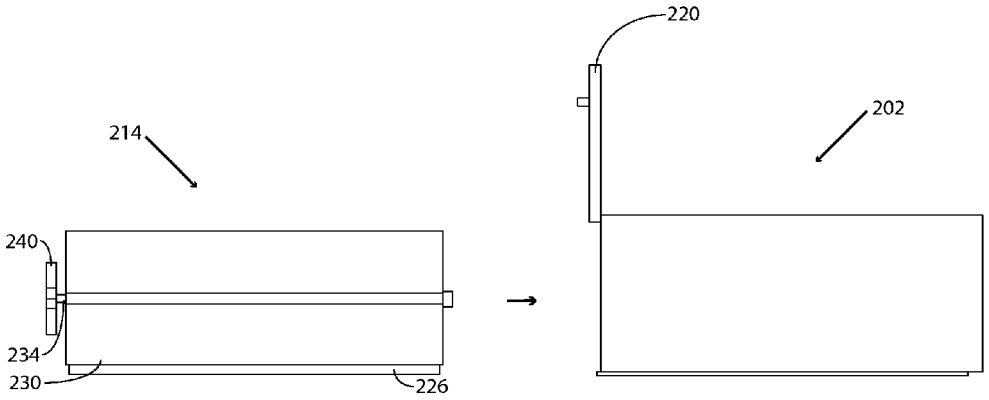
FIG. 2D schematically shows a cleaning material component being inserted into the cleaning material support component of the cleaning implement of FIG. 2A from a side view.
Figure 2E:
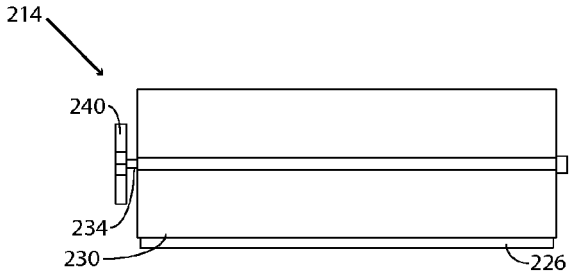
FIG. 2E schematically depicts a cleaning material component of the cleaning implement of FIG. 2A from a side view.
Figure 2F:
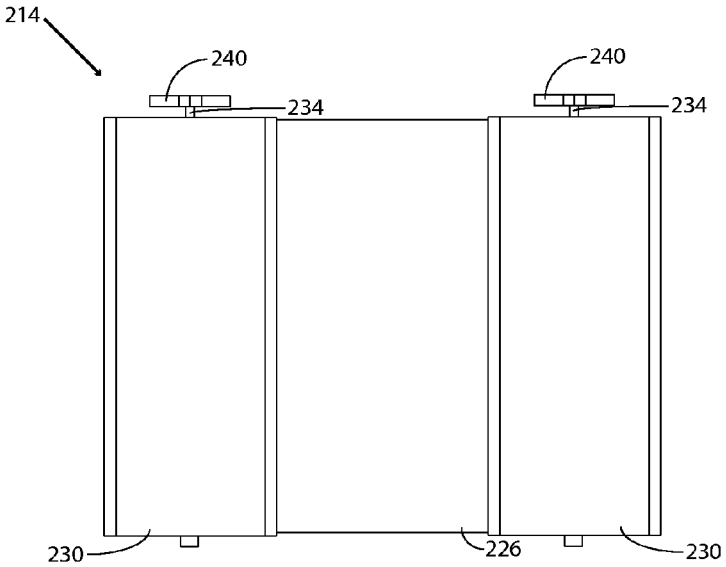
FIG. 2F schematically depicts a cleaning material component of the cleaning implement of FIG. 2A from a top side view.
Figure 2G:
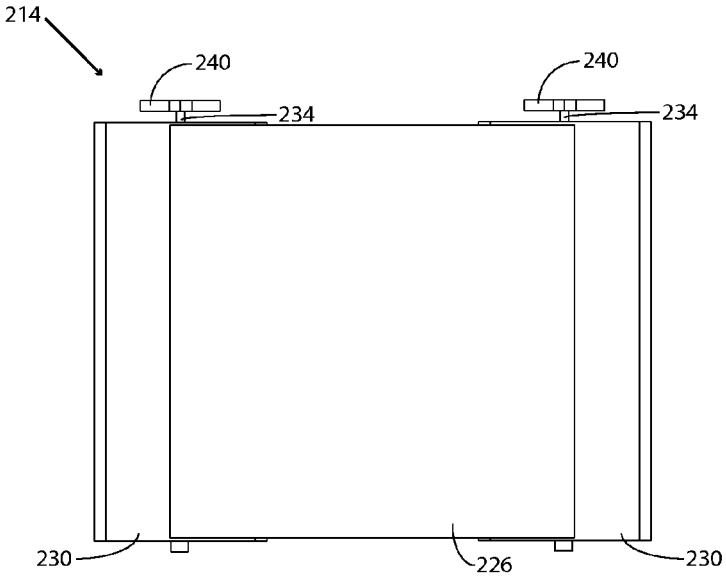
FIG. 2G schematically shows a cleaning material component of the cleaning implement of FIG. 2A from a bottom side view.
Figure 2H:
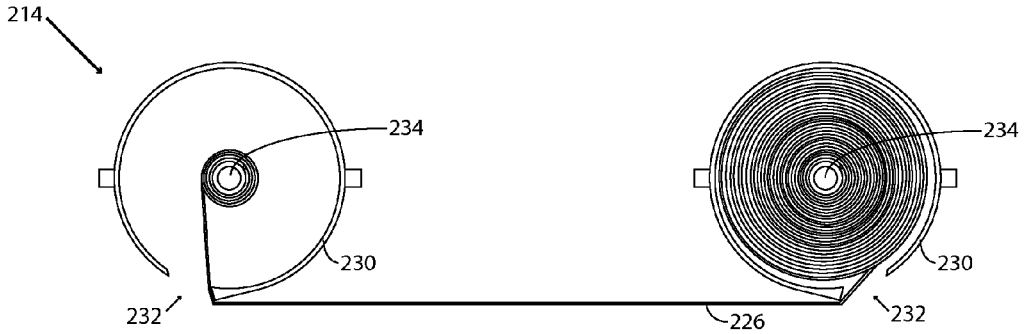
FIG. 2H schematically shows a sectional view of a cleaning material component of the cleaning implement of FIG. 2A.
Figure 2I:
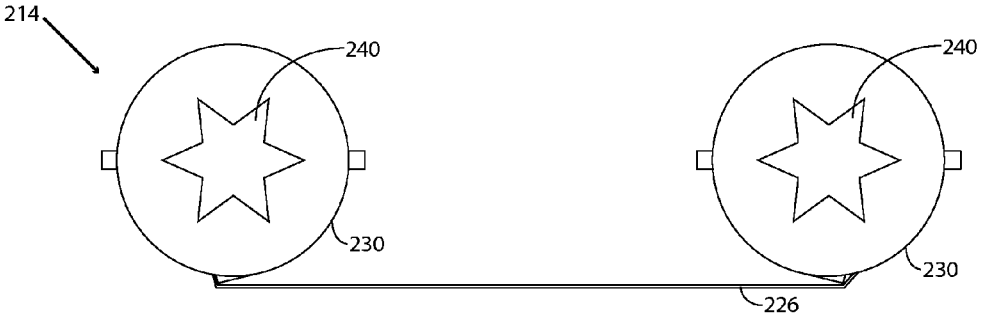
FIG. 2I schematically illustrates a cleaning material component of the cleaning implement of FIG. 2A from a side view.
Figure 2J:
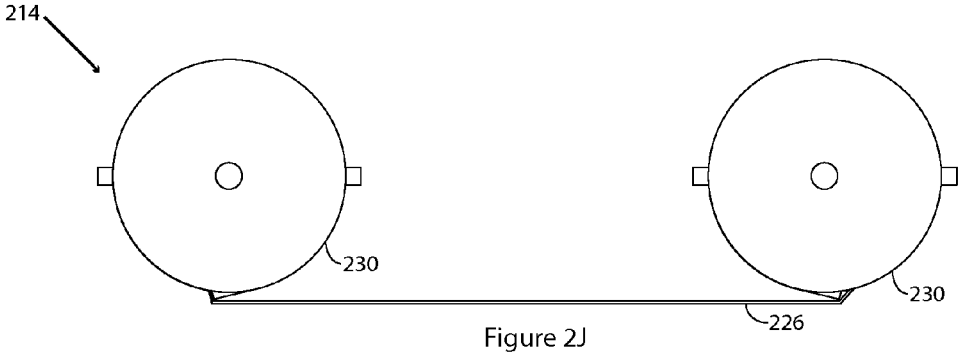
FIG. 2J schematically illustrates a cleaning material component of the cleaning implement of FIG. 2A from a side view.
Figure 2K:
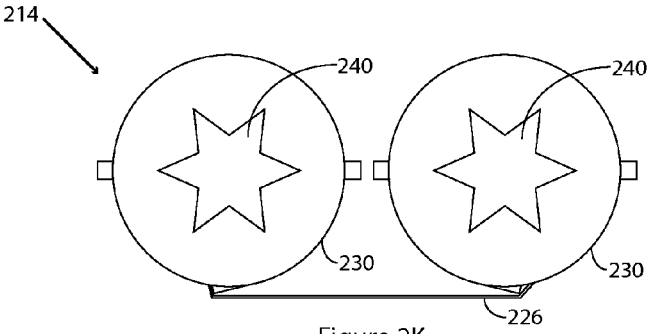
FIG. 2K schematically illustrates a cleaning material component of the cleaning implement of FIG. 2A from a side view.

FIGS. 2A-2N schematically show cleaning implements, cleaning material components, or components thereof from various views according to some embodiment of the invention. As shown, cleaning implement 200 includes head component 202 which includes cleaning material support component 204 and cleaning surface component 206. Cleaning material support component 204 includes cleaning material support component surfaces 208 that at least partially define cleaning material receiving areas 210 (shown as cleaning implement cartridge receiving areas). As also shown, cleaning material support components 204 include openings 212 that are structured such that cleaning material receiving areas 210 communicate with cleaning surface component 206. As shown, cleaning material receiving areas 210 are configured to receive cleaning material component 214 (shown as a cleaning implement cartridge that includes a cleaning material roll) such that at least a portion of cleaning material component 214 is movable to and/or from cleaning material receiving areas 210 to extend over at least a portion of cleaning surface component 206. In addition, cleaning implement 200 also includes retaining component 220 (shown as a door structure) that operably engages cleaning material support component 204 via slide component 222 in this exemplary embodiment.

Cleaning material component 214 includes cleaning material support structures 230 and cleaning material 226 (shown as a rolled sheet of cleaning material). Cleaning material support structures 230 (shown as substantially cylindrically-shaped housings) form cavities that are each structured to house and support cleaning material 226 such that cleaning material 226 is movable to and/or from cleaning material support structures 230 via orifices 232. Orifices 232 are configured to communicate with openings 212. Cleaning material support structures and corresponding cleaning material receiving areas are optionally formed to include various cross-sectional shapes, including, e.g., circles, ovals, squares, rectangles, regular n-sided polygons, irregular n-sided polygons, etc. As shown, cleaning material support structure 230 is configured to be received in cleaning material receiving area 210 of cleaning implement 200 and cleaning material 226 is configured to extend over cleaning surface component 206 of cleaning implement 200 via orifices 232 and openings 212.

In some embodiments, cleaning material support structures and/or cleaning materials of cleaning material components include one or more alignment components that are configured to align cleaning materials relative to cleaning material support structures. To illustrate, cleaning material support structures 230 of cleaning material component 214 includes rod 234 that extends within cleaning material support structure 230. As shown, the alignment component (rod 234) of cleaning material support structure 230 inserts into a corresponding central receiving area of the cleaning material roll (cleaning material 226) to align cleaning material 226 relative to cleaning material support structures 230.

In certain embodiments, cleaning implements and/or cleaning material components operably connect, or are operably connectable, to conveyance mechanisms or components thereof. In cleaning implement 200, for example, rod 234 extends through cleaning material support structure 230 and operably connects to conveyance mechanism components 240 (shown as manual conveyance components (e.g., manually operated handles)). Conveyance mechanism components 240 are configured to rotate cleaning material roll (cleaning material 226) selected distances such that cleaning material 226 is positioned at selected positions relative to cleaning surface component 206. Other exemplary conveyance mechanisms are described herein or otherwise known to those skilled in the art.

Typically, cleaning material support components of cleaning implements and/or cleaning material components include one or more alignment features that are structured to align those components relative to one another when the cleaning material components are disposed in the cleaning material receiving areas of the cleaning implements. In one exemplary embodiment, for example, cleaning material support structure 230 and cleaning material support component 204 include alignment features 242 and 244, respectively (schematically shown as corresponding tongue and groove-type components), that are structured to align cleaning material support structure 230 relative to cleaning material support component 204 cleaning implement 200.

The cleaning implements of the invention typically include one or more handle components. As shown in FIG. 2L, for example, cleaning implement 201 includes handle component 245. To further illustrate, cleaning implement 200 includes handle 246 operably connected to head component 202. Handle 246 is pivotally connected to head component 202 via pivot mechanism 248 (shown as a ball and socket mechanism).

To further illustrate, FIGS. 3 A-N schematically show a cleaning implement, a cleaning material component, or components thereof from various views according to one exemplary embodiment of the invention. As shown, cleaning implement 300 includes head component 302 which includes cleaning material support component 304 and cleaning surface component 306. Cleaning material support component 304 includes cleaning material support component surfaces 308 that at least partially define cleaning material receiving areas 310 (shown as cleaning implement cartridge receiving areas). As also shown, cleaning material support components 304 include openings 312 that are structured such that cleaning material receiving areas 310 communicate with cleaning surface component 306. As shown, cleaning material receiving areas 310 are configured to receive cleaning material component 314 (shown as a cleaning implement cartridge that includes a cleaning material roll) such that at least a portion of cleaning material component 314 is movable to and/or from cleaning material receiving area 310 to extend over at least a portion of cleaning surface component 306. In addition, cleaning implement 300 also includes retaining component 320 (shown as a door structure) that operably engages cleaning material support component 304 via slide component 322 in this exemplary embodiment. In some embodiments, cleaning surface components include holes that communicate with suction or vacuum components, e.g., that assist in holding cleaning materials in place relative to the cleaning surface components during use of the cleaning implements.

Cleaning material component 314 includes cleaning material support structures 330 and cleaning material 326 (shown as a rolled sheet of cleaning material). Cleaning material support structures 330 (shown as substantially cylindrically-shaped housings) form cavities that are each structured to house and support cleaning material 326 such that cleaning material 326 is movable to and/or from cleaning material support structures 330 via orifices 332. Orifices 332 are configured to communicate with openings 312. Cleaning material support structures and corresponding cleaning material receiving areas are optionally formed to include various cross-sectional shapes, including, e.g., circles, ovals, squares, rectangles, regular n-sided polygons, irregular n-sided polygons, etc. As shown, cleaning material support structure 330 is configured to be received in cleaning material receiving area 310 of cleaning implement 300 and cleaning material 326 is configured to extend over cleaning surface component 306 of cleaning implement 300 via orifices 332 and openings 312.

In some embodiments, cleaning material support structures and/or cleaning materials of cleaning material components include one or more alignment components that are configured to align cleaning materials relative to cleaning material support structures. To illustrate, cleaning material support structures 330 of cleaning material component 314 includes rod 334 that extends within cleaning material support structure 330. As shown, the alignment component (rod 334) of cleaning material support structure 330 inserts into a corresponding central receiving area of the cleaning material roll (cleaning material 326) to align cleaning material 326 relative to cleaning material support structures 330.

In certain embodiments, cleaning implements and/or cleaning material components operably connect, or are operably connectable, to conveyance mechanisms or components thereof to effect conveyance of cleaning materials, e.g., selected incremental distances. In cleaning implement 300, for example, rod 334 extends through cleaning material support structure 330 and operably connects to gear components 340. Gear components 340 are configured to operably engage (e.g., mesh with, etc.) gear component 341 of head component 302 when cleaning material component 314 is disposed in cleaning material receiving areas 310. As shown, gear component 341 is operably connected to motor 343 (e.g., a stepper motor, a servo motor, etc.) via shaft 345. Power source 347 (shown as a battery, e.g., a disposable battery, a rechargeable battery, etc.) operably connects to motor 343 to provide power to motor 343. Essentially any power source is optionally adapted for use with the cleaning implements of the invention. In some embodiments, for example, motors are operably connected to power cords that plug into power outlets. In other exemplary embodiments, photovoltaic cells are mounted cleaning implements to provide power to motors. Motor 343 effects rotation of cleaning material roll (cleaning material 326) (via gear components 340 and 341) selected distances such that cleaning material 326 is positioned at selected positions relative to cleaning surface component 306.

In some embodiments, the cleaning implements of the invention include processors, controllers (e.g., microcontrollers, etc.), or the like that are configured to effect operation of various components. In some embodiments, for example, cleaning implements include controllers that include logic instructions, stored in a memory component, which when executed effect rotation (via motors) of cleaning material rolls selected distances (e.g., a length of a cleaning surface component). Essentially any processor or controller is optionally adapted for use with the cleaning implements of the invention.

Typically, cleaning material support components of cleaning implements and/or cleaning material components include one or more alignment features that are structured to align those components relative to one another when the cleaning material components are disposed in the cleaning material receiving areas of the cleaning implements. In one exemplary embodiment, for example, cleaning material support structure 330 and cleaning material support component 304 include alignment features 342 and 344, respectively (schematically shown as corresponding tongue and groove-type components), that are structured to align cleaning material support structure 330 relative to cleaning material support component 304 cleaning implement 300.

Figure 3A:
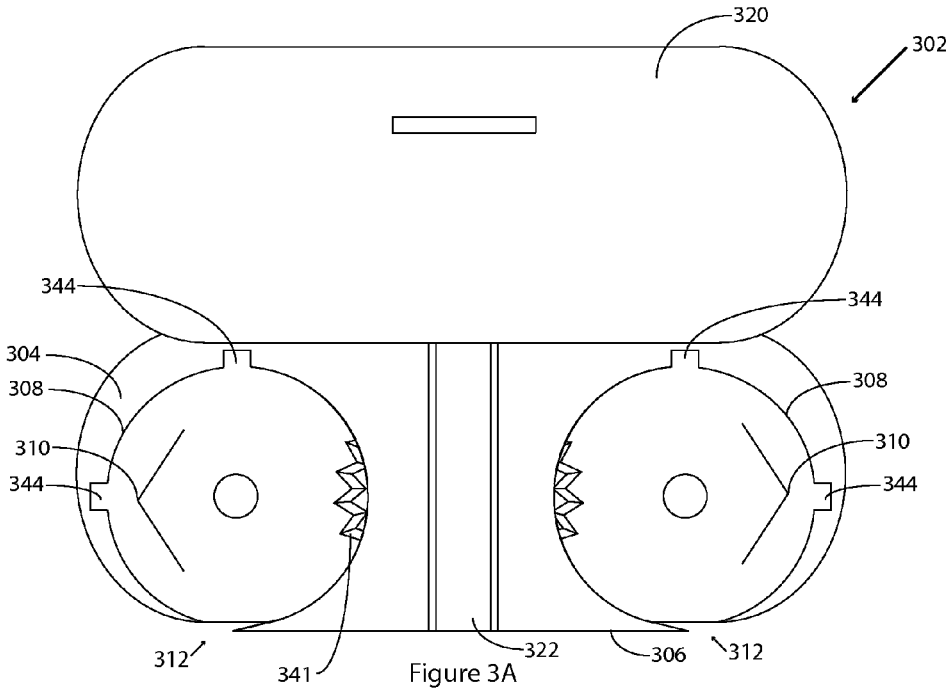
FIG. 3A schematically illustrates a head component of a cleaning implement from a side view according to one embodiment of the invention.
Figure 3B:
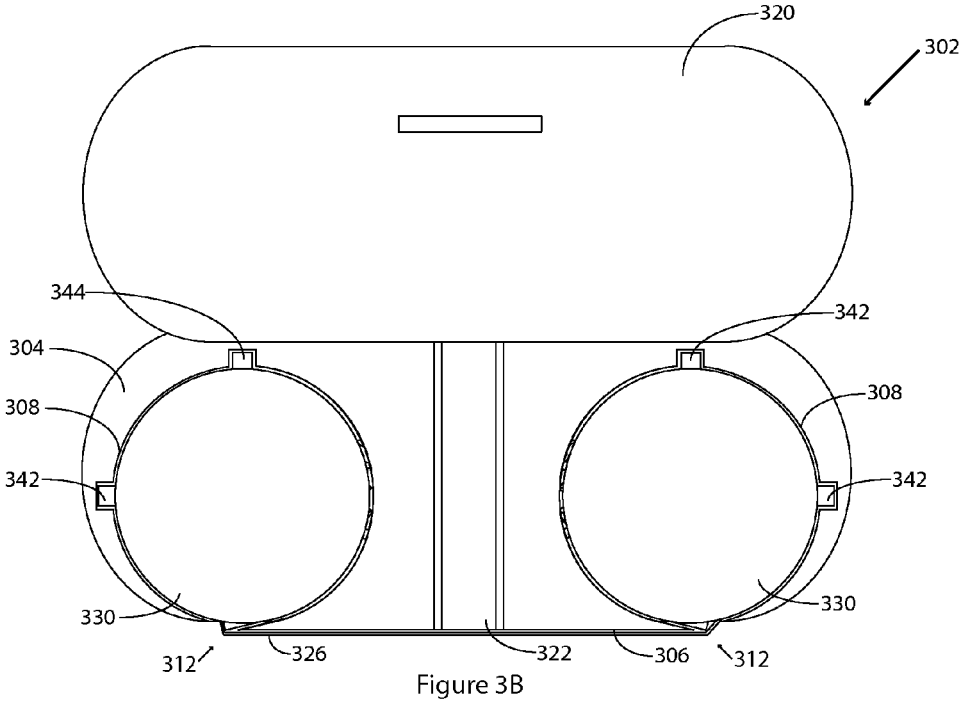
FIG. 3B schematically shows the head component of the cleaning implement of FIG. 3A including a cleaning material component from a side view.
Figure 3C:
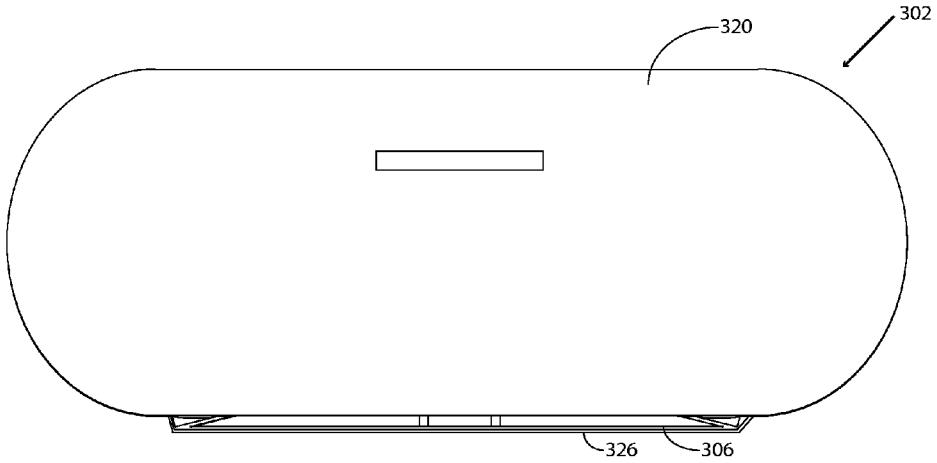
FIG. 3C schematically depicts the cleaning implement of FIG. 3A with an exemplary retaining component in a closed position from a side view.
Figure 3D:
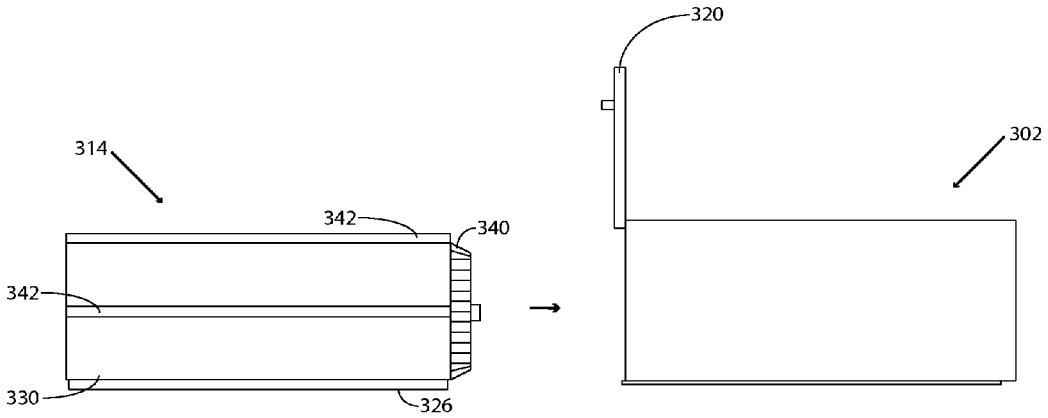
FIG. 3D schematically shows a cleaning material component being inserted into the cleaning material support component of the cleaning implement of FIG. 3A from a side view.
Figure 3E:
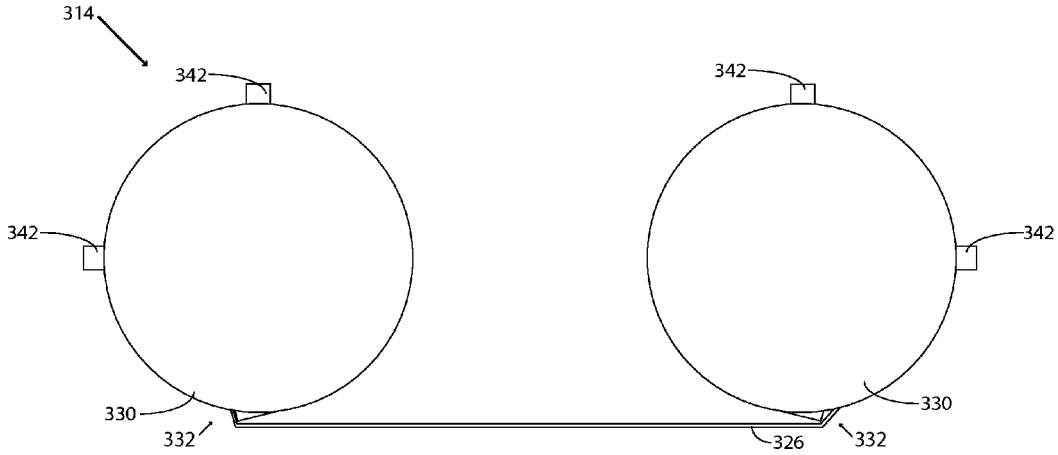
FIG. 3E schematically depicts a cleaning material component of the cleaning implement of FIG. 3A from a side view.
Figure 3F:
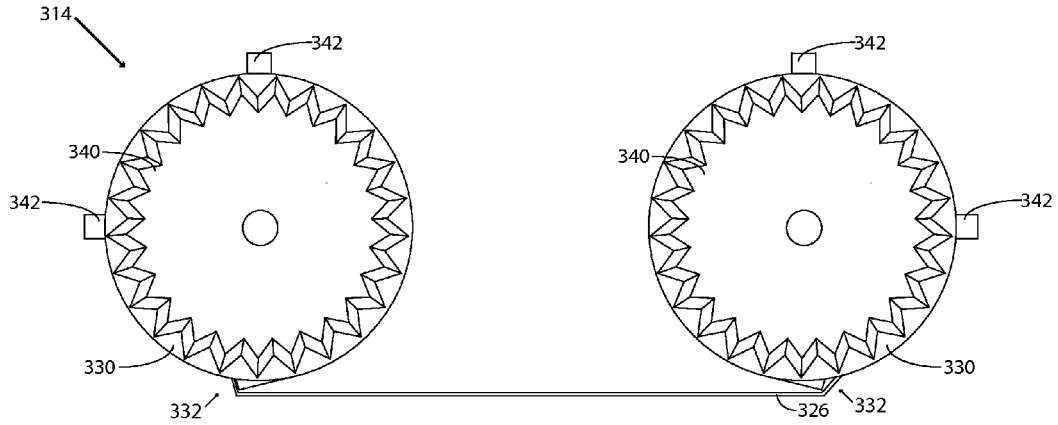
FIG. 3F schematically depicts a cleaning material component of the cleaning implement of FIG. 3A from a side view.
Figure 3G:
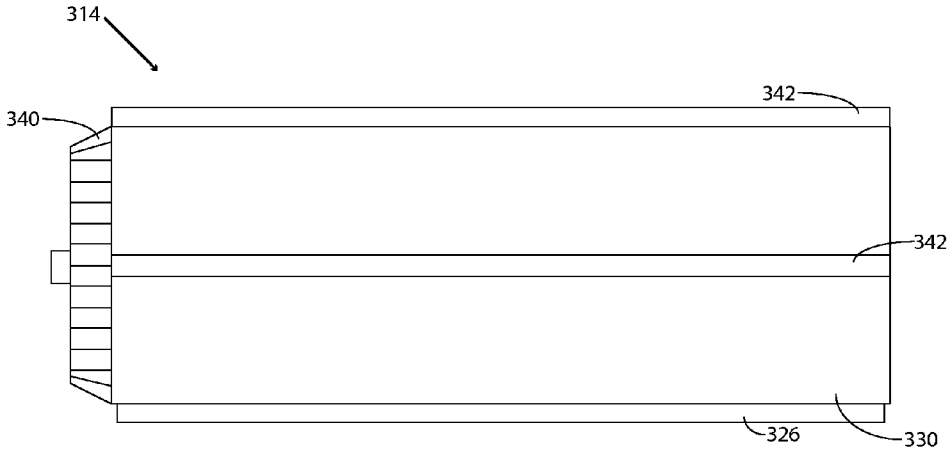
FIG. 3G schematically depicts a cleaning material component of the cleaning implement of FIG. 3A from a side view.
Figure 3H:
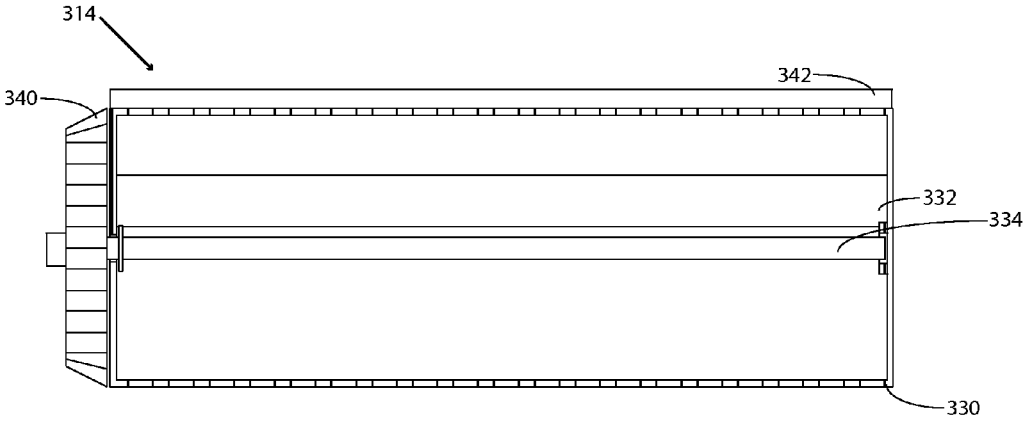
FIG. 3H schematically shows a sectional view of a cleaning material support component of a cleaning material component according to one embodiment of the invention.
Figure 3I:
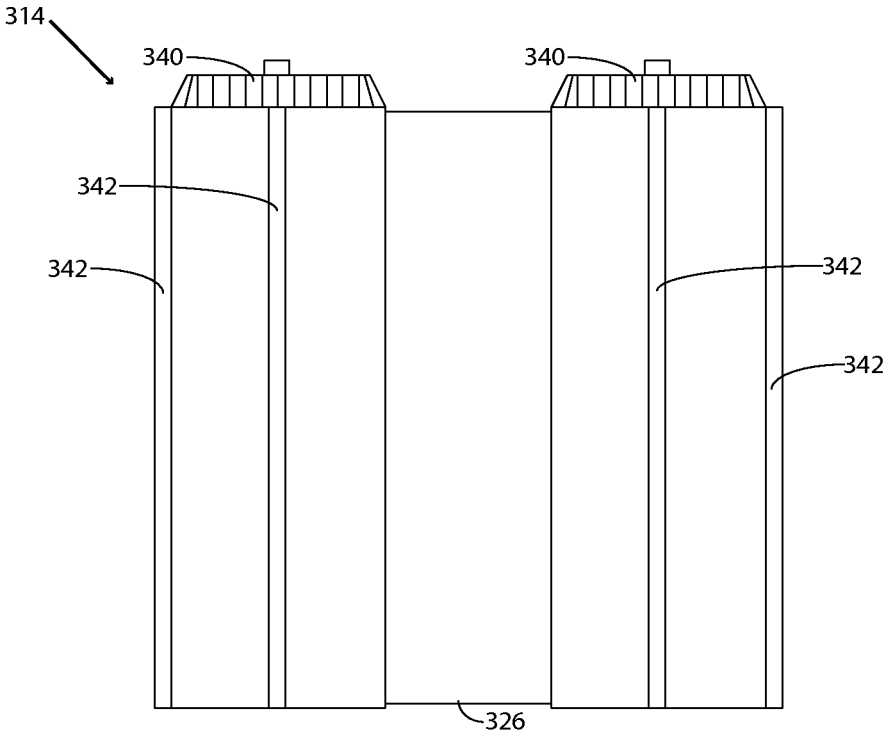
FIG. 3I schematically depicts a cleaning material component of the cleaning implement of FIG. 3A from a top side view.
Figure 3J:
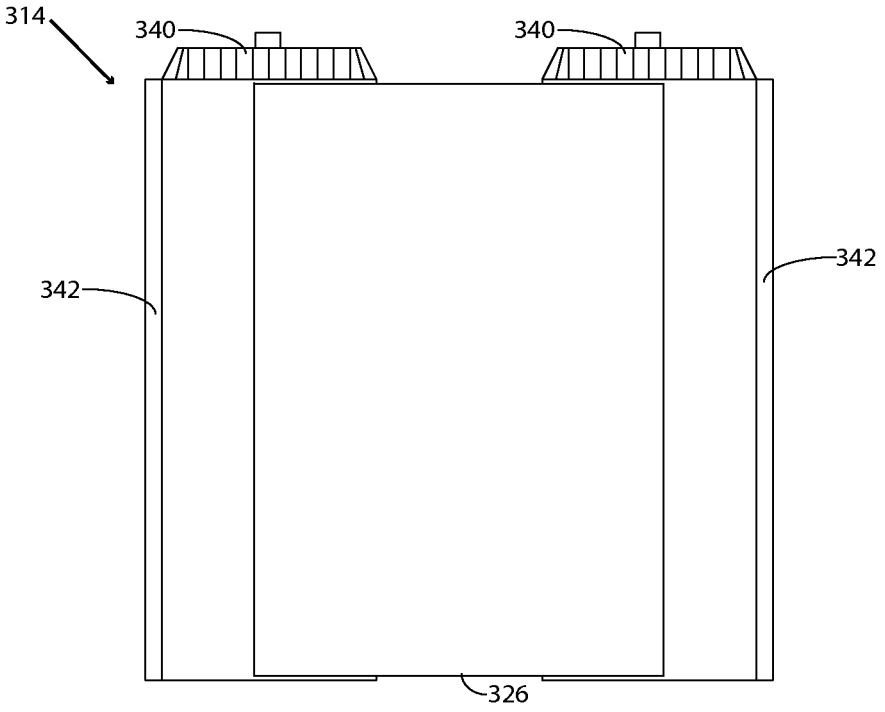
FIG. 3J schematically shows a cleaning material component of the cleaning implement of FIG. 3A from a bottom side view.
Figure 3K:
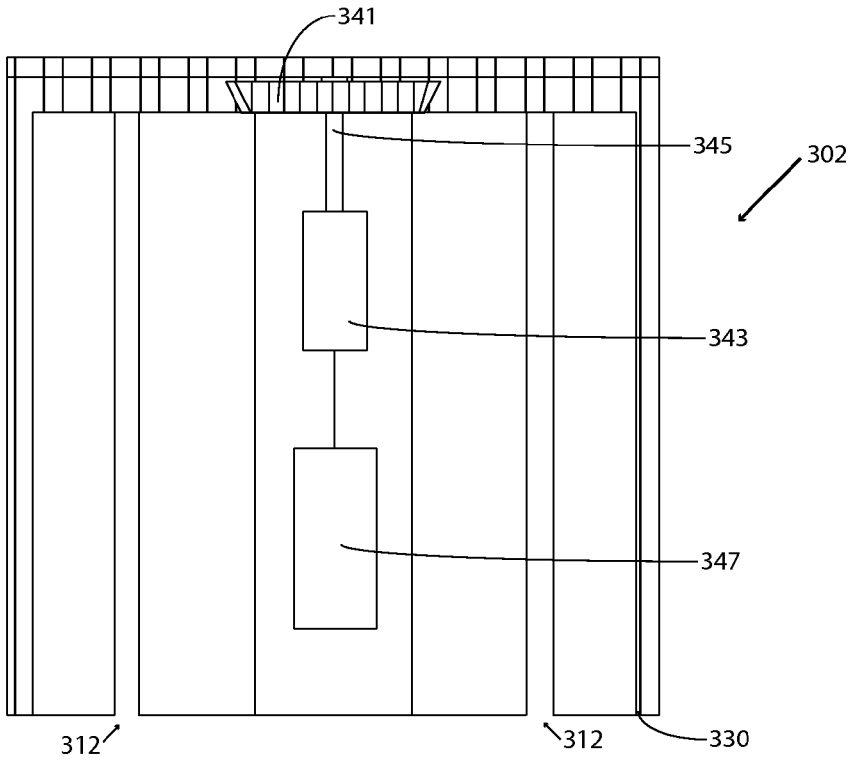
FIG. 3K schematically depicts the head component of the cleaning implement of FIG. 3A from a sectional top side view.
Figure 3L:
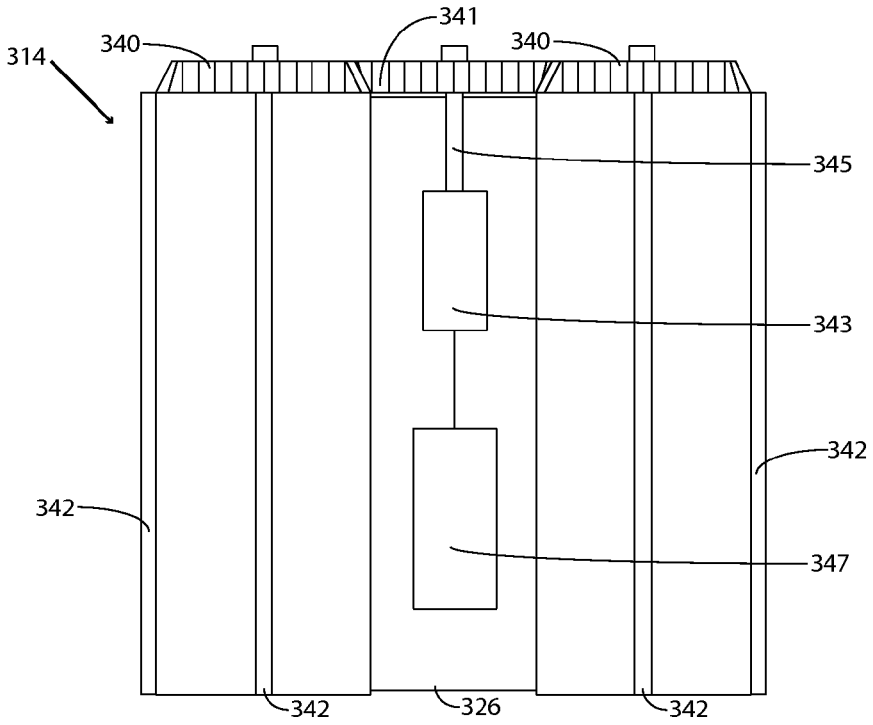
FIG. 3L schematically shows a cleaning material component operably engaging a conveyance mechanism of the cleaning implement of FIG. 3A from a top side view.
Figure 3M:
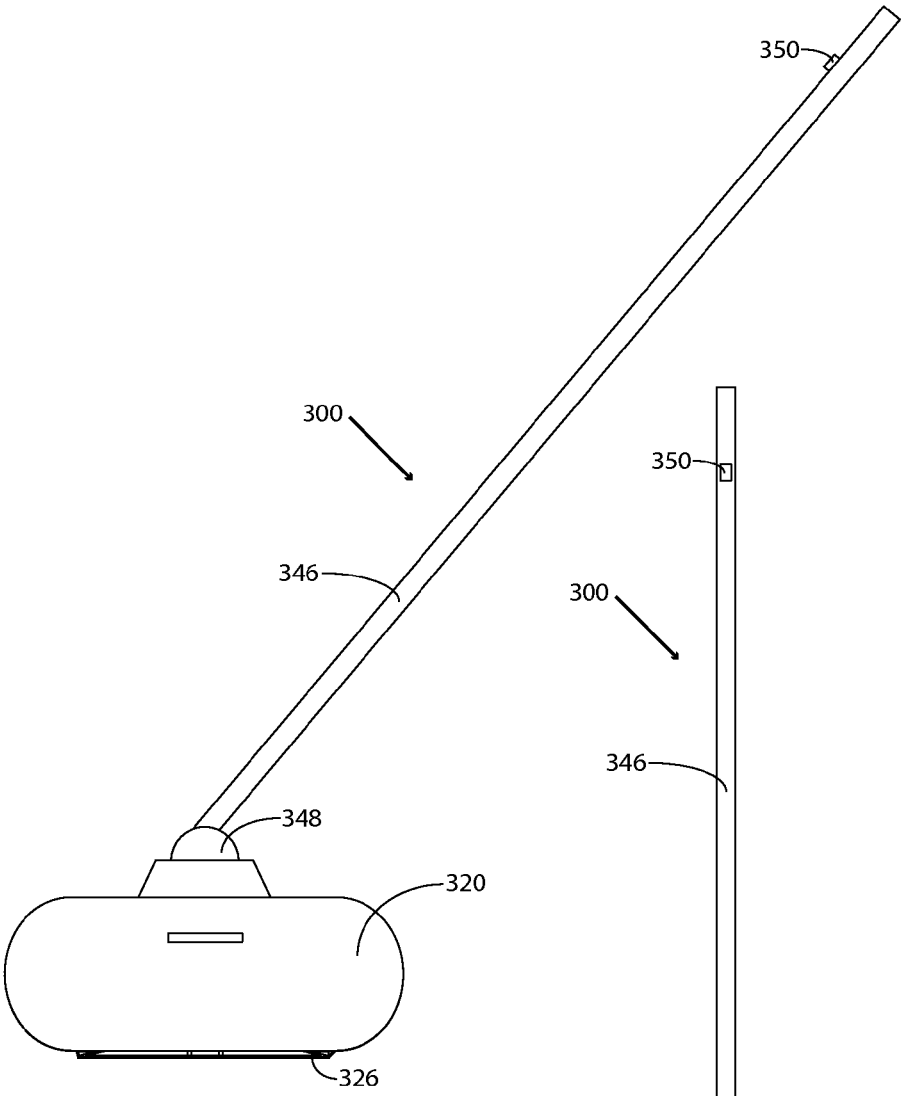
FIG. 3M schematically shows the head component of a cleaning implement of FIG. 3A with a handle from a side view.
Figure 3N:
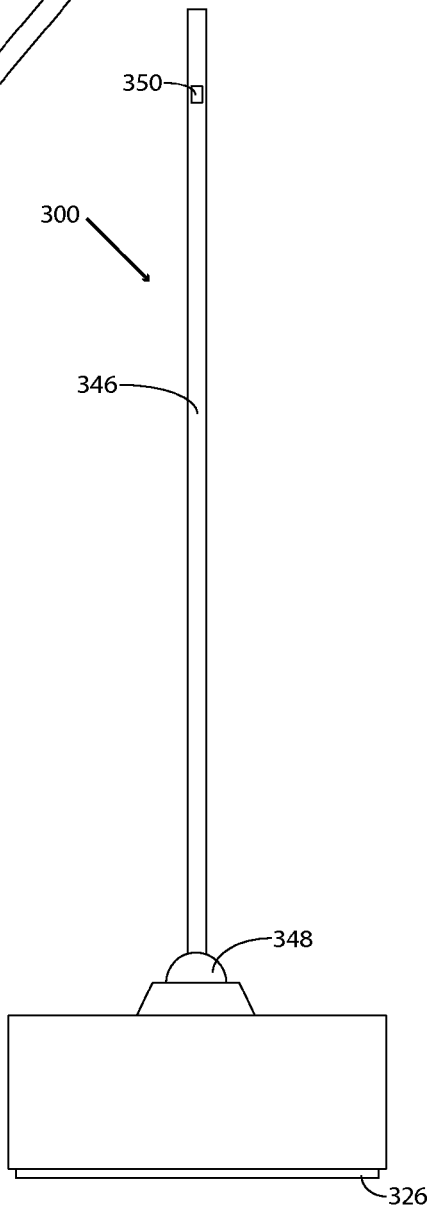
FIG. 3N schematically shows the cleaning implement of FIG. 3M with a handle from a front side view.

The cleaning implements of the invention typically include one or more handle components. As shown in FIGS. 3M and 3N, for example, cleaning implement 300 includes handle 346 operably connected to head component 302. Handle 346 is pivotally connected to head component 302 via pivot mechanism 348 (shown as a ball and socket mechanism). As also shown, handle 346 includes switch 350 which is operably connected to motor 343. Switch 350 is used to effect movement of cleaning material 326 via the conveyance mechanism described above.

To further illustrate, FIGS. 4 A-P schematically show a cleaning implement, a cleaning material component, or components thereof from various views according to one exemplary embodiment of the invention. As shown, cleaning implement 400 includes head component 402 which includes cleaning material support component 404 and cleaning surface component 406. Cleaning material support component 404 includes cleaning material support component surfaces 408 that at least partially define cleaning material receiving areas 410 (shown as cleaning implement cartridge receiving areas). As also shown, cleaning material support components 404 include openings 412 that are structured such that cleaning material receiving areas 410 communicate with cleaning surface component 406. As shown, cleaning material receiving areas 410 are configured to receive cleaning material component 414 (shown as a cleaning implement cartridge that includes a cleaning material roll) such that at least a portion of cleaning material component 414 is movable to and/or from cleaning material receiving area 410 to extend over at least a portion of cleaning surface component 406. In addition, cleaning implement 400 also includes retaining component 420 (shown as a door structure) that operably engages cleaning material support component 404 via slide component 422 in this exemplary embodiment.

Cleaning material component 414 includes cleaning material support structures 430 and cleaning material 426 (shown as a rolled sheet of cleaning material). Cleaning material support structures 430 (shown as substantially cylindrically-shaped housings) form cavities that are each structured to house and support cleaning material 426 such that cleaning material 426 is movable to and/or from cleaning material support structures 430 via orifices 432. Orifices 432 are configured to communicate with openings 412. Cleaning material support structures and corresponding cleaning material receiving areas are optionally formed to include various cross-sectional shapes, including, e.g., circles, ovals, squares, rectangles, regular n-sided polygons, irregular n-sided polygons, etc. As shown, cleaning material support structure 430 is configured to be received in cleaning material receiving area 410 of cleaning implement 400 and cleaning material 426 is configured to extend over cleaning surface component 406 of cleaning implement 400 via orifices 432 and openings 412.

In some embodiments, cleaning material support structures and/or cleaning materials of cleaning material components include one or more alignment components that are configured to align cleaning materials relative to cleaning material support structures. To illustrate, cleaning material support structures 430 of cleaning material component 414 includes rod 434 that extends within cleaning material support structure 430. As shown, the alignment component (rod 434) of cleaning material support structure 430 inserts into a corresponding central receiving area of the cleaning material roll (cleaning material 426) to align cleaning material 426 relative to cleaning material support structures 330.

In certain embodiments, cleaning implements and/or cleaning material components operably connect, or are operably connectable, to conveyance mechanisms or components thereof to effect conveyance of cleaning materials, e.g., selected incremental distances. In cleaning implement 400, for example, rod 434 extends through cleaning material support structure 430 and operably connects to conveyance mechanism component 440 that is configured to operably engage gear components 439. In particular, projections 437 of conveyance mechanism component 440 are configured to be received by projection receiving areas 435 of gear components 439. Gear components 439 are rotatably retained in head component 402 and configured to operably engage (e.g., mesh with, etc.) gear component 441 of head component 402, for example, when cleaning material component 414 is disposed in cleaning material receiving areas 410. As shown, gear component 441 is operably connected to motor 443 (e.g., a stepper motor, a servo motor, etc.) via shaft 445. Power source 447 (shown as a battery, e.g., a disposable battery, a rechargeable battery, etc.) operably connects to motor 443 to provide power to motor 443. Essentially any power source is optionally adapted for use with the cleaning implements of the invention. In some embodiments, for example, motors are operably connected to power cords that plug into power outlets. In other exemplary embodiments, photovoltaic cells are mounted cleaning implements to provide power to motors. Motor 443 effects rotation of cleaning material roll (cleaning material 426) (via gear components 439 and 441) selected distances such that cleaning material 426 is positioned at selected positions relative to cleaning surface component 406.

Typically, cleaning material support components of cleaning implements and/or cleaning material components include one or more alignment features that are structured to align those components relative to one another when the cleaning material components are disposed in the cleaning material receiving areas of the cleaning implements. In one exemplary embodiment, for example, cleaning material support structure 430 and cleaning material support component 404 include alignment features 442 and 444, respectively (schematically shown as corresponding tongue and groove-type components), that are structured to align cleaning material support structures 430 relative to cleaning material support component 404 of cleaning implement 400.

Figure 4A:
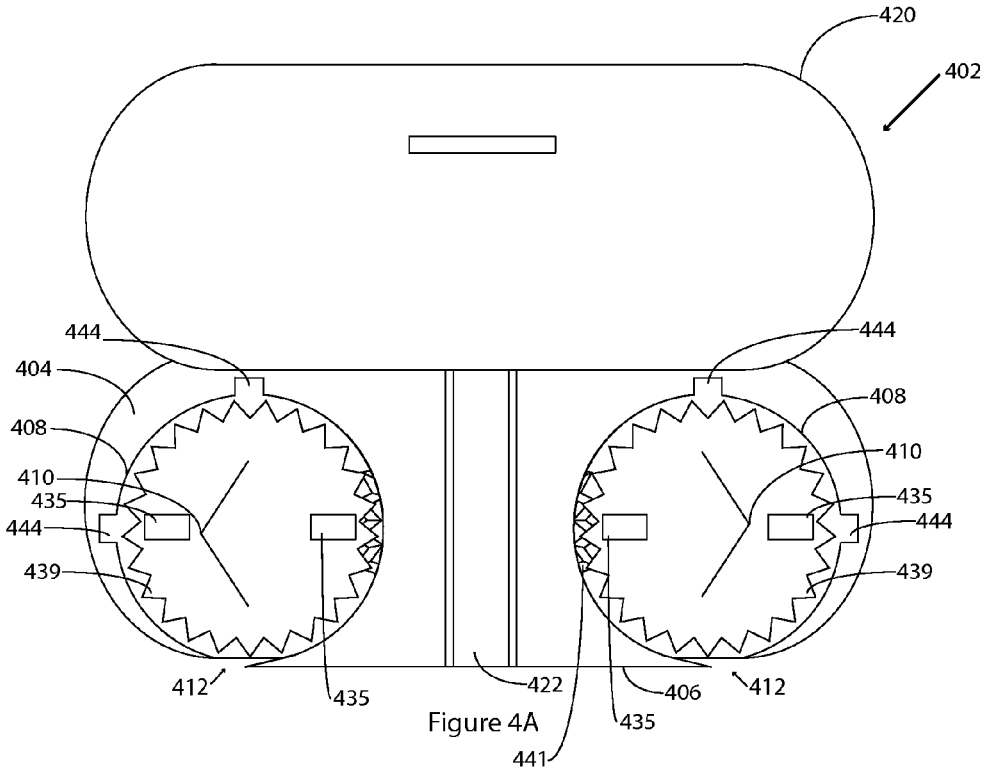
FIG. 4A schematically illustrates a head component of a cleaning implement from a side view according to one embodiment of the invention.
Figure 4B:
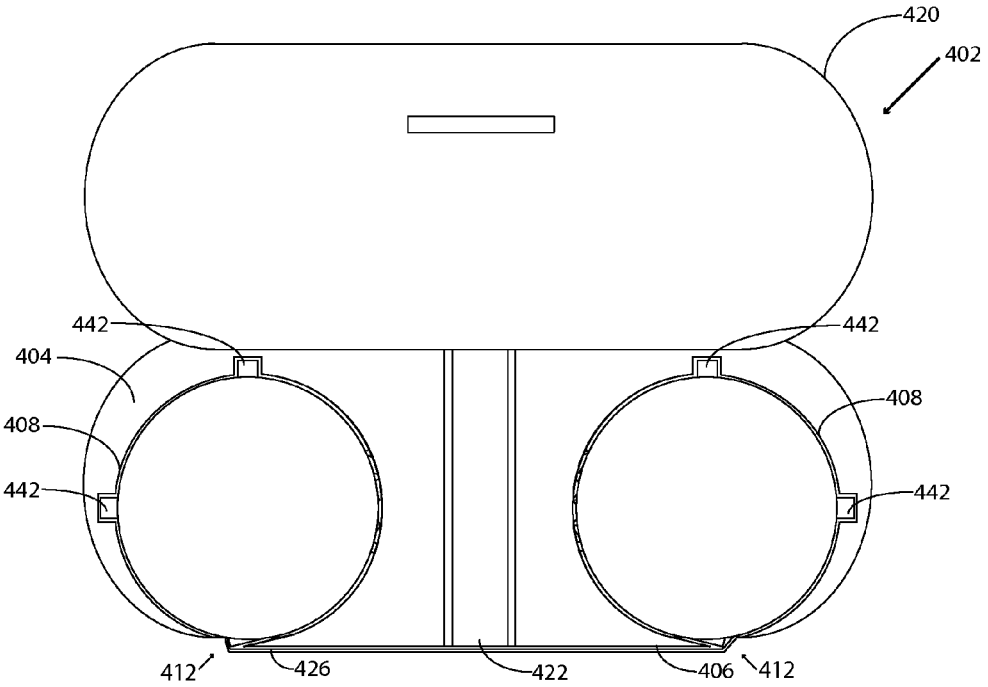
FIG. 4B schematically shows the head component of the cleaning implement of FIG. 4A including a cleaning material component from a side view.
Figure 4C:
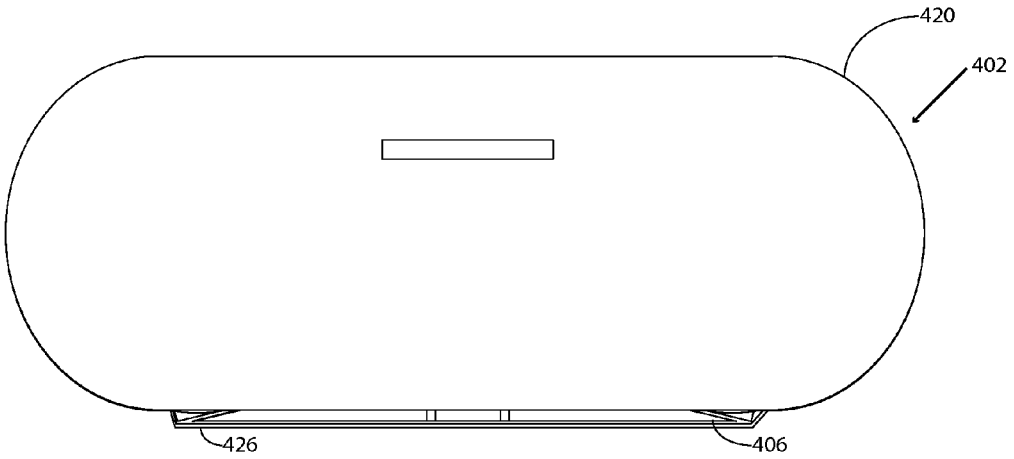
FIG. 4C schematically depicts the cleaning implement of FIG. 4A with an exemplary retaining component in a closed position from a side view.
Figure 4D:
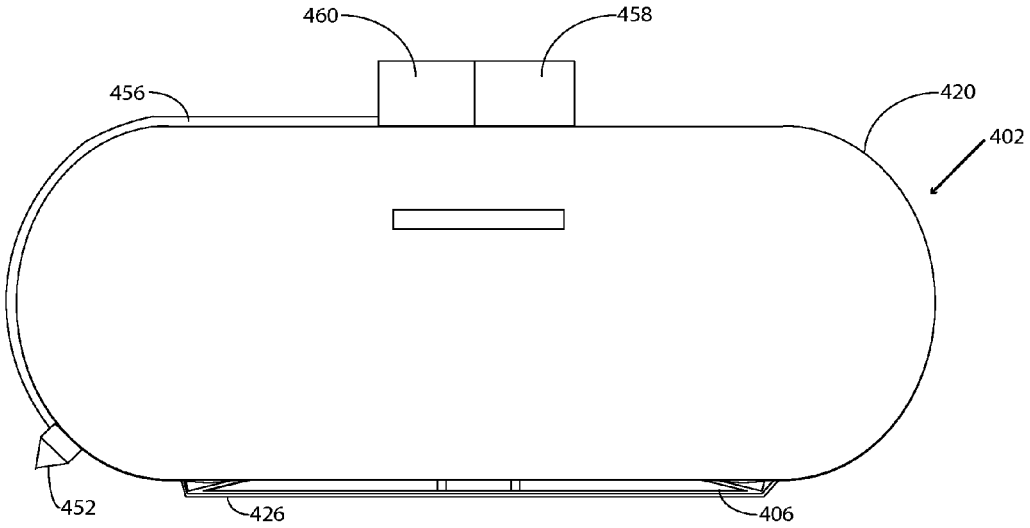
FIG. 4D schematically depicts the cleaning implement of FIG. 4A with components of an exemplary fluid handling mechanism from a side view.
Figure 4E:
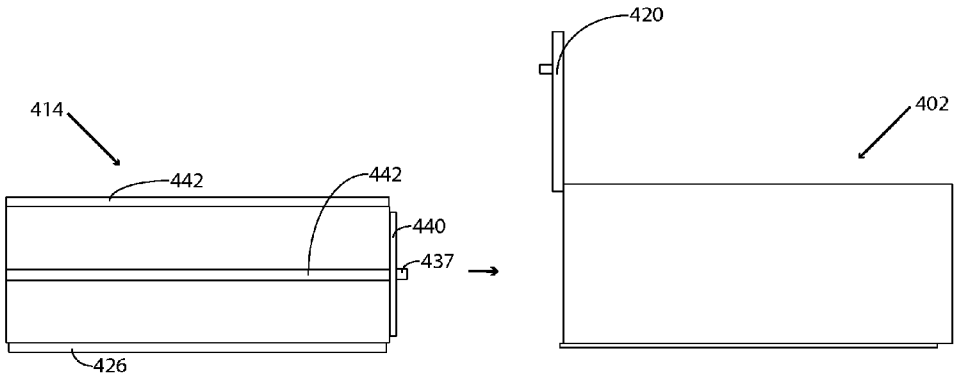
FIG. 4E schematically shows a cleaning material component being inserted into the cleaning material support component of the cleaning implement of FIG. 4A from a side view.
Figure 4F:
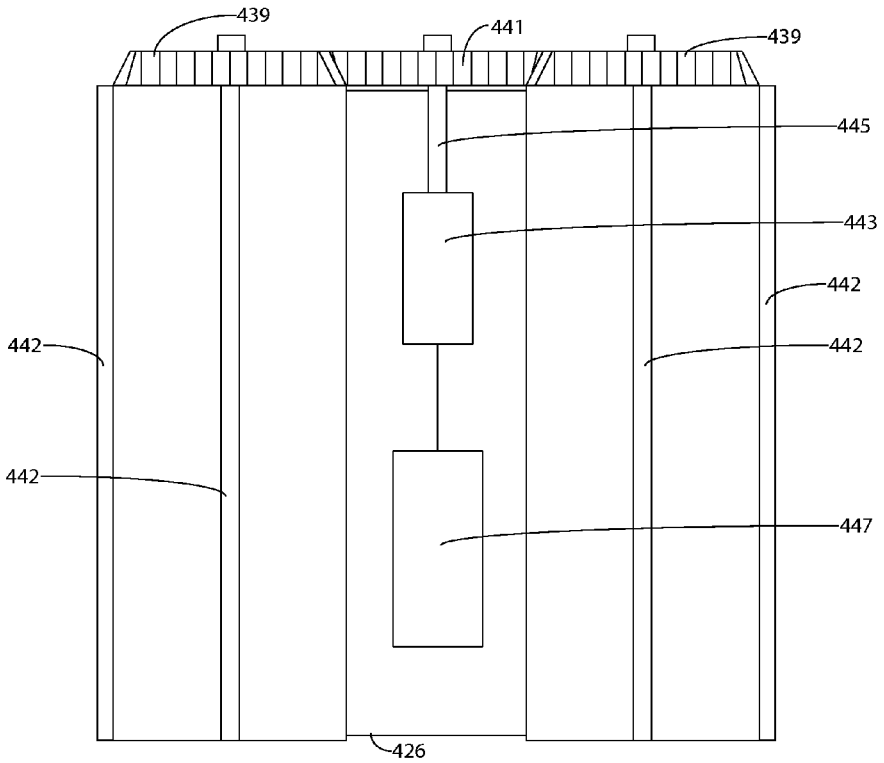
FIG. 4F schematically shows a cleaning material component operably engaging a conveyance mechanism of the cleaning implement of FIG. 4A from a top side view.
Figure 4G:
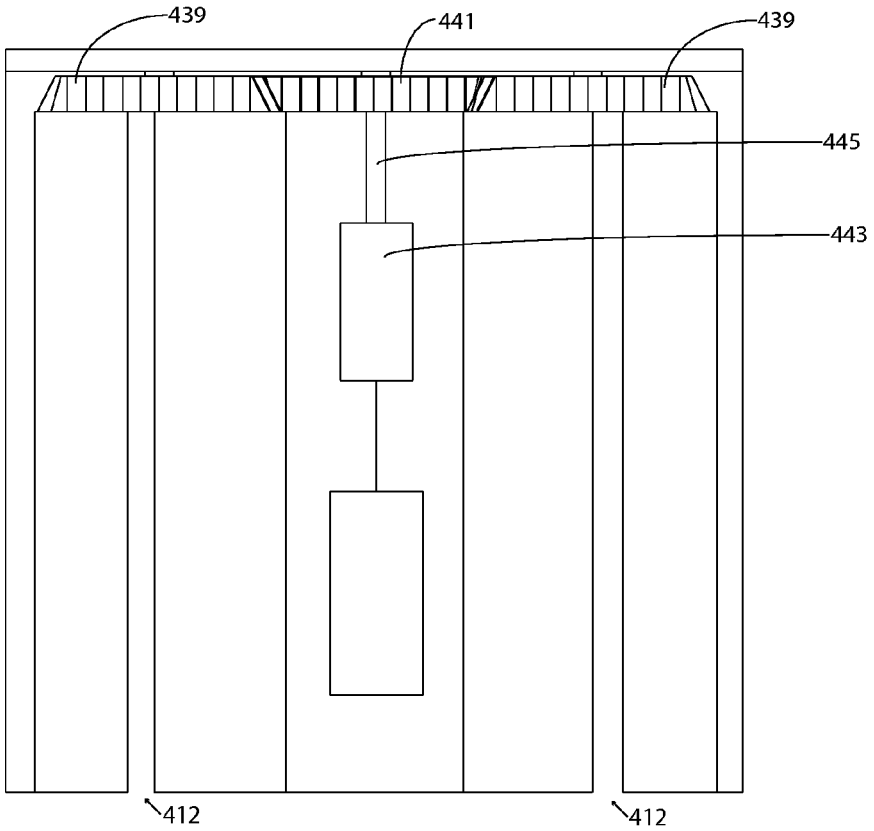
FIG. 4G schematically depicts the head component of the cleaning implement of FIG. 4A from a sectional top side view.
Figure 4H:
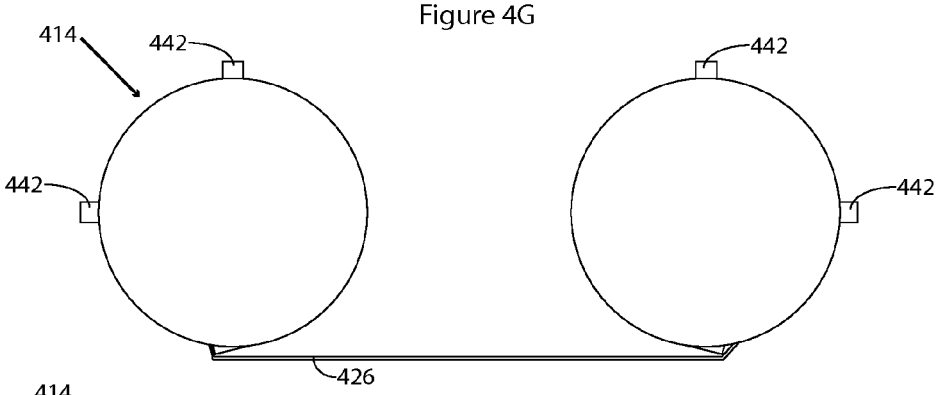
FIG. 4H schematically depicts a cleaning material component of the cleaning implement of FIG. 4A from a side view.
Figure 4I:
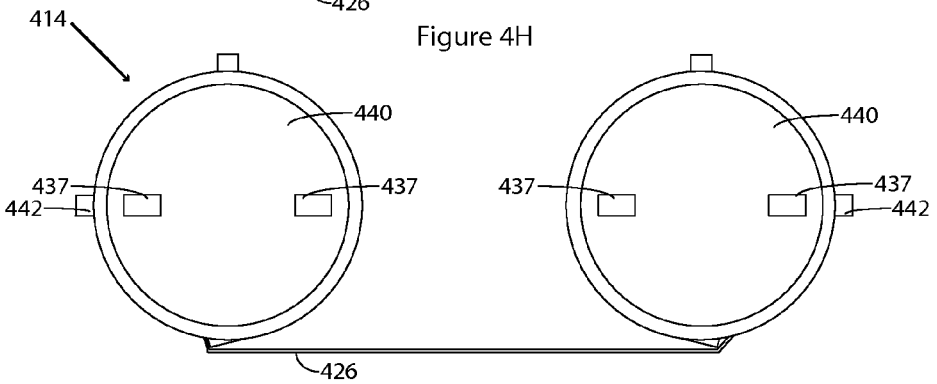
FIG. 4I schematically depicts a cleaning material component of the cleaning implement of FIG. 4A from a side view.
Figure 4J:
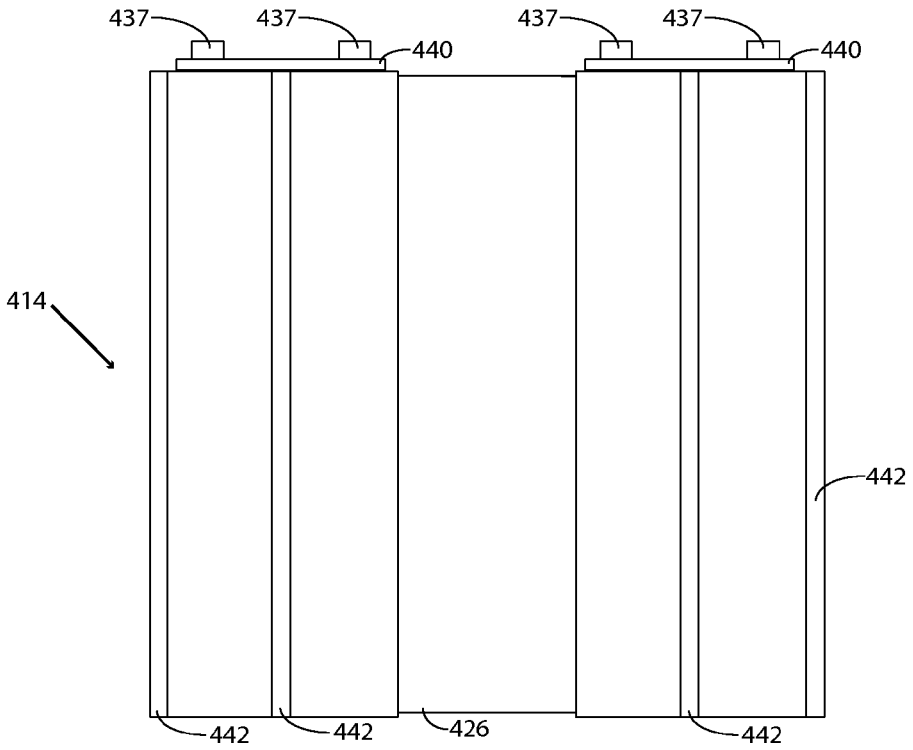
FIG. 4J schematically depicts a cleaning material component of the cleaning implement of FIG. 4A from a top side view.
Figure 4K:
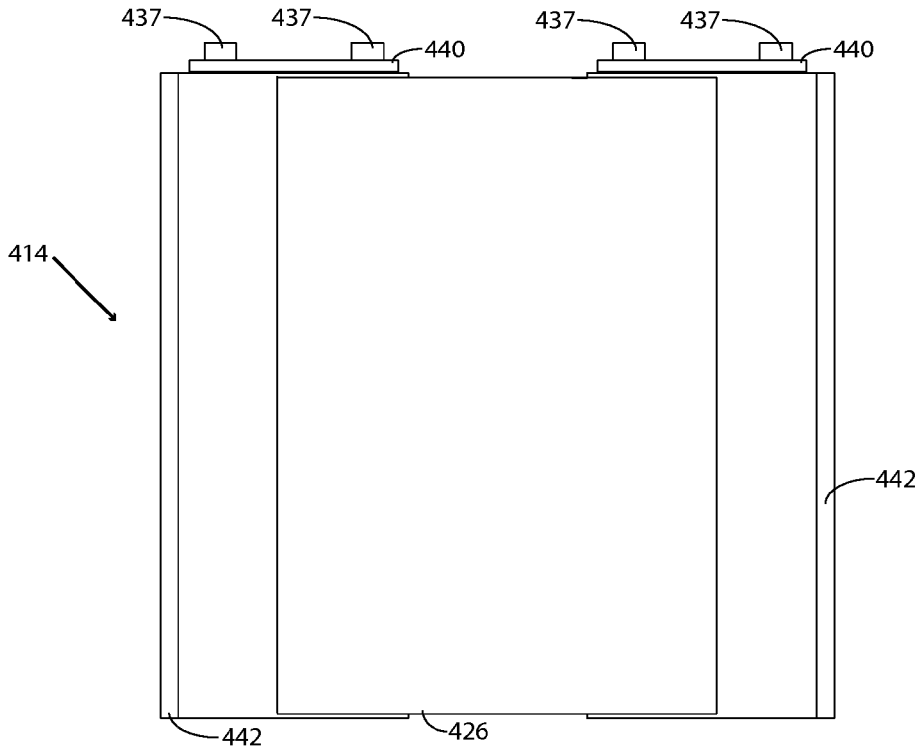
FIG. 4K schematically shows a cleaning material component of the cleaning implement of FIG. 4A from a bottom side view.
Figure 4L:
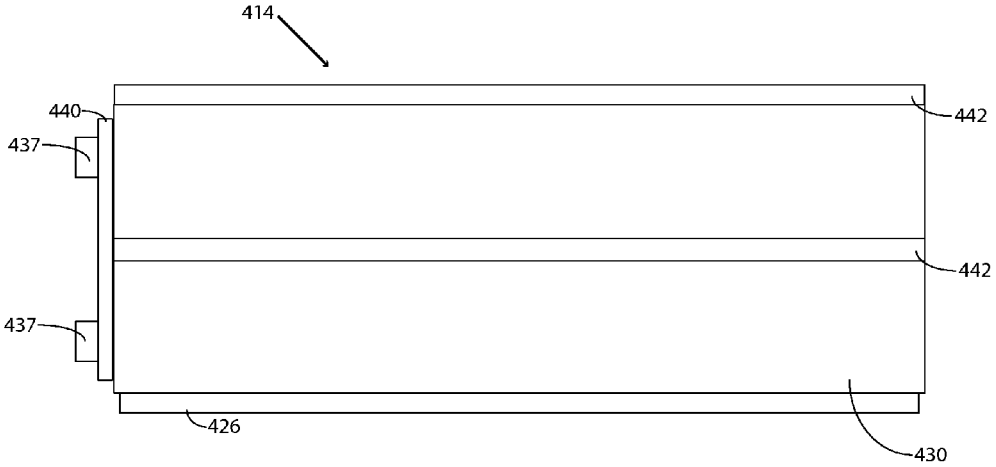
FIG. 4L schematically depicts a cleaning material component of the cleaning implement of FIG. 4A from a side view.
Figure 4M:
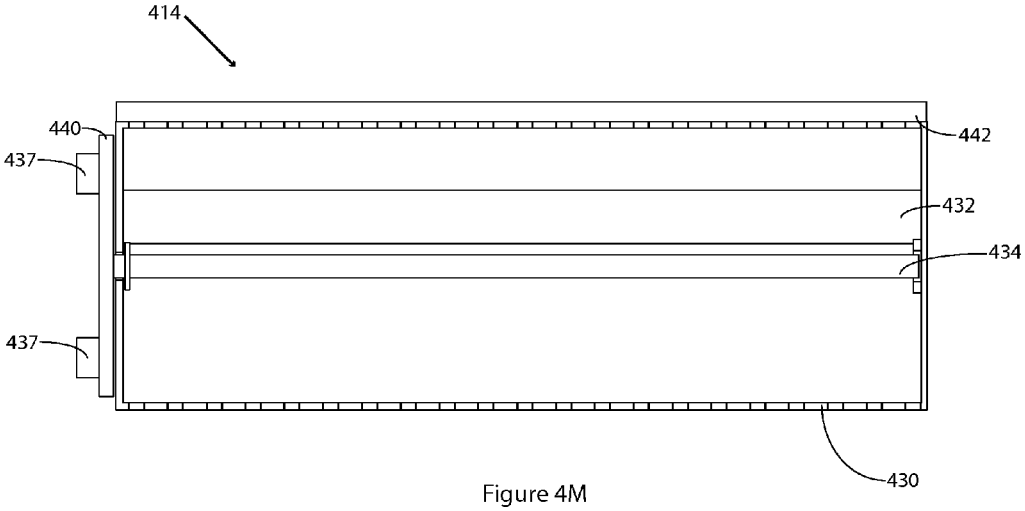
FIG. 4M schematically shows a sectional view of a cleaning material support component of a cleaning material component according to one embodiment of the invention.
Figures 4N, 4O:
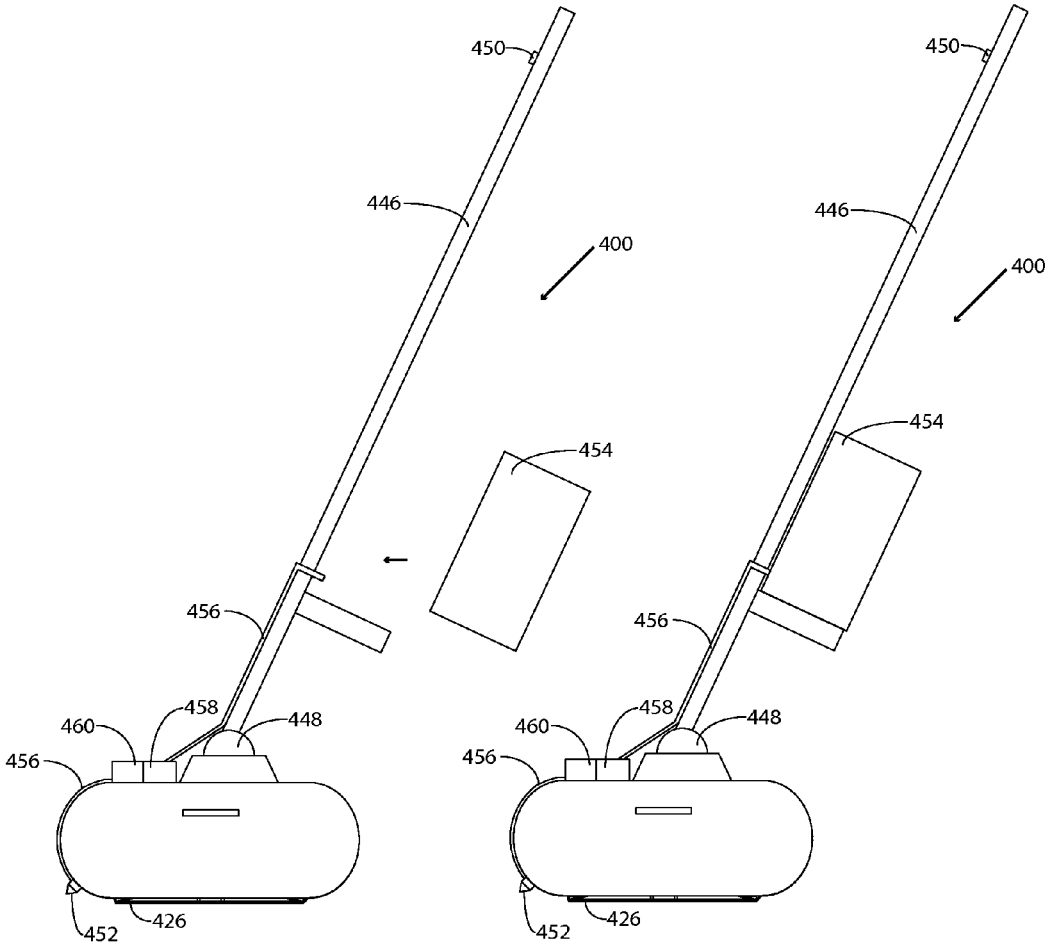
FIG. 4N schematically shows the head component of a cleaning implement of FIG. 4A with a handle and a removable fluid container being positioned relative to the cleaning implement from a side view.
FIG. 4O schematically shows the head component of a cleaning implement of FIG. 4A with a handle from a side view.
Figure 4P:
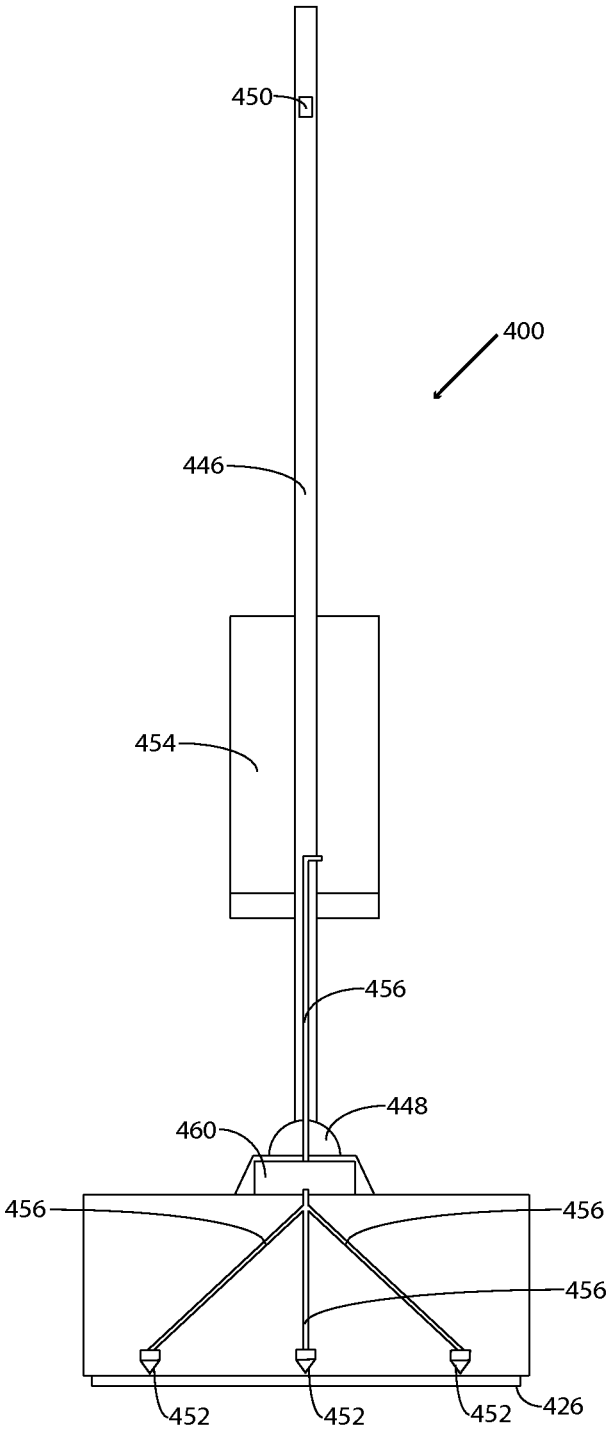
FIG. 4P schematically shows the cleaning implement of FIG. 4O with a handle from a front side view.

The cleaning implements of the invention typically include one or more handle components. As shown in FIGS. 4N and 4P, for example, cleaning implement 400 includes handle 446 operably connected to head component 402. Handle 446 is pivotally connected to head component 402 via pivot mechanism 448 (shown as a ball and socket mechanism). As also shown, handle 446 includes switch 450 which is operably connected to motor 443. Switch 450 is used to effect movement of cleaning material 426 via the conveyance mechanism described above.

In some embodiments, cleaning implements include fluid handling mechanisms that can be used, for example, to distribute fluid (e.g., a cleaning fluid, etc.) to a surface to cleaned, to a cleaning material of a cleaning implement (e.g., to moisten the cleaning material prior to or during use of the cleaning implement, etc.), and/or the like. To illustrate one exemplary embodiment, cleaning implement 400 includes a fluid handling mechanism that comprises a fluid source (container 454) and fluid outlets (nozzles 452) (shown disposed proximal to a surface of head component 402). The fluid handling mechanism is configured to convey fluid from container 454 to nozzles 452, which communicate via fluid conduit 456. The fluid handling mechanism of cleaning implement 400 also includes pumping mechanism 458 (e.g., a rotary lobe pump, a rotary gear pump, a screw pump, a gear pump, a peristaltic pump, or the like) that is configured to pump the fluid from container 454 to nozzles 452. As also shown, the fluid handling mechanism also includes vaporization component 460 (e.g., a steam vaporizer or the like) that is configured to vaporize the fluid at least proximal to nozzles 452. In the embodiment shown, container 454 is removable from cleaning implement 400 such that container 454 can be, e.g., refilled with a cleaning fluid, replaced with a new container when container 454 is fabricated as a consumable component of cleaning implement 400, etc. In some embodiments, containers are fabricated integral or otherwise fixedly attached to cleaning implements. Switch 450 is also configured to effect operation of pumping mechanism 458 and vaporization component 460.

To further illustrate, FIGS. 5 A-F schematically show a cleaning implement, a cleaning material component, or components thereof from various views according to one exemplary embodiment of the invention. As shown, cleaning implement 500 includes head component 502 which includes cleaning material support component 504 and cleaning surface component 506. Cleaning material support component 504 includes cleaning material support component surfaces 508 that at least partially define cleaning material receiving area 510 (shown as a track- or groove-type area into which cleaning material band 514 inserts and moves within). As also shown, cleaning material support component 504 includes openings 512 that are structured such that cleaning material receiving area 510 communicates with cleaning surface component 506. Cleaning surface component 506 also includes elevational element 507. Elevational element 507, for example, assists head component 502 in pivoting relative to a surface being cleaned during use. Essentially any elevational element is optionally used with the cleaning implement embodiments of the invention. Additional exemplary elevational elements that are optionally adapted for use with the cleaning implement embodiments of the invention are described in, e.g., U.S. Pat. No. 7,096,531, entitled "Cleaning implement for cleaning a surface" which issued Aug. 29, 2006 to Policicchio, which is incorporated by reference in its entirety. Cleaning surface components optionally include essentially any cross-sectional shape (e.g., rounded or curved cross-sections, etc.). As shown, cleaning material receiving area 510 is configured to receive cleaning material component 514 (shown as a cleaning material band) such that at least a portion of cleaning material component 514 is movable to and/or from cleaning material receiving area 510 to extend over at least a portion of cleaning surface component 506. In addition, cleaning implement 500 also includes retaining component 520 (shown as a door structure) that operably engages cleaning material support component 504 via slide component 522 in this exemplary embodiment.

In certain embodiments, cleaning implements and/or cleaning material components operably connect, or are operably connectable, to conveyance mechanisms or components thereof to effect conveyance of cleaning materials, e.g., selected incremental distances. Cleaning implement 500, for example, includes roller cylinders 524 that are configured to operably engage cleaning material component 514 and to rotate in head component 502 such that cleaning material component 514 moves, e.g., user selected incremental distances relative to cleaning surface component 506 (e.g., due to frictional forces between roller cylinders 524 and cleaning material component 514 as roller cylinders 524 rotate). Optionally, roller cylinders include sprocket or gear teeth and cleaning material components (e.g., cleaning material rolls, cleaning material bands, cleaning sheets, etc.) include perforations that correspond to the sprocket or gear teeth (e.g., similar to a camera that uses certain types of film) such that the sprocket or gear teeth effect movement of the cleaning material components when the roller cylinders rotate. Sprocket or gear teeth/perforation configurations are optionally adapted for use with other embodiments of the invention as well. Although not within view in FIGS. 5 A-F, cleaning implement 500 also includes gear components, a shaft, a motor (e.g., a stepper motor, a servo motor, etc.), and a power source (e.g., a disposable battery, a rechargeable battery, etc.) similar to those described with respect to cleaning implement 300, referred to above. The motor effects rotation of roller cylinders 524 and cleaning material component 514 (via gear components) selected distances such that cleaning material component 514 is positioned at selected positions relative to cleaning surface component 506.

Figure 5A:
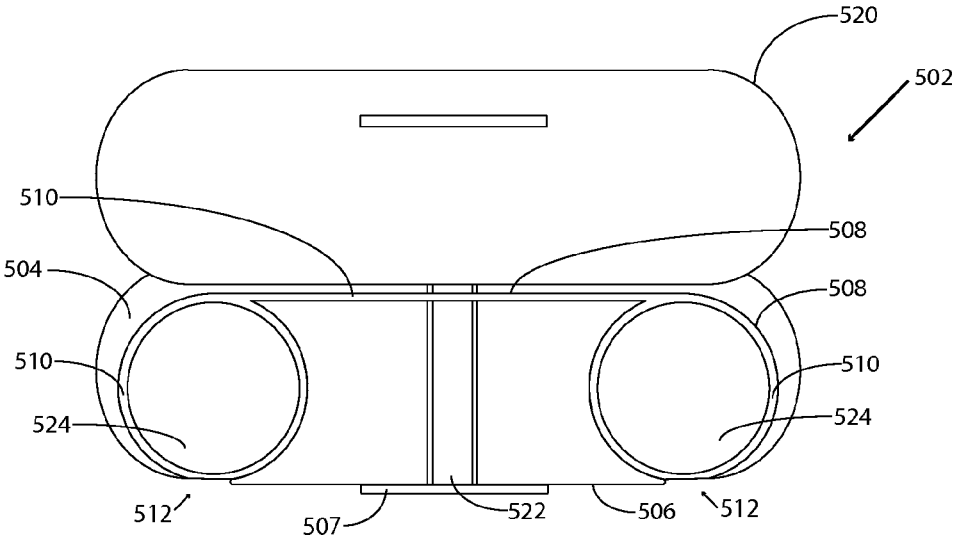
FIG. 5A schematically illustrates a head component of a cleaning implement from a side view according to one embodiment of the invention.
Figure 5B:
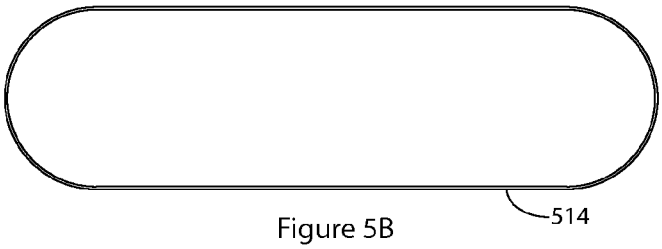
FIG. 5B schematically shows a cleaning material component from a side view according to one embodiment of the invention.
Figure 5C:
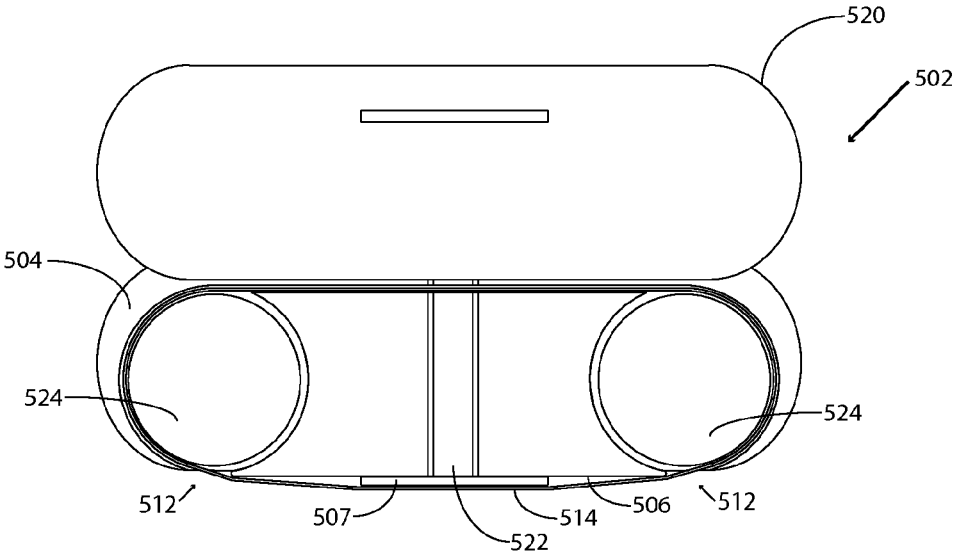
FIG. 5C schematically illustrates the head component of the cleaning implement of FIG. 5A including the cleaning material component of FIG. 5B from a side view.
Figure 5D:
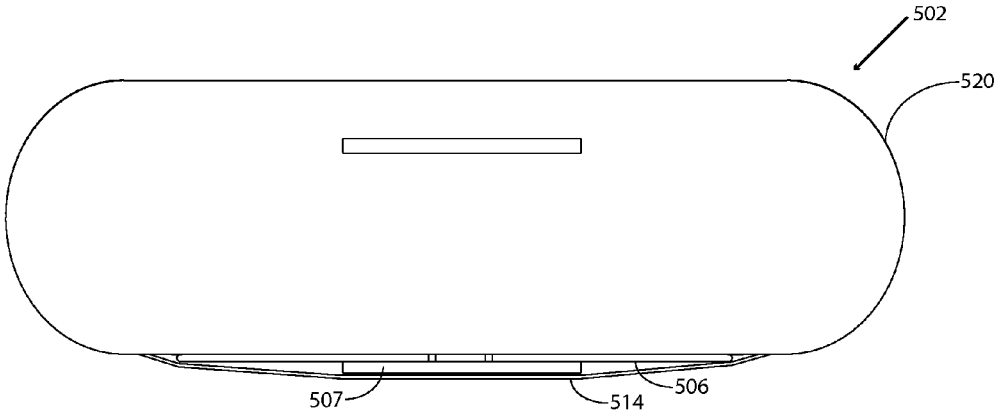
FIG. 5D schematically depicts the cleaning implement of FIG. 5C with an exemplary retaining component in a closed position from a side view.
Figure 5E:
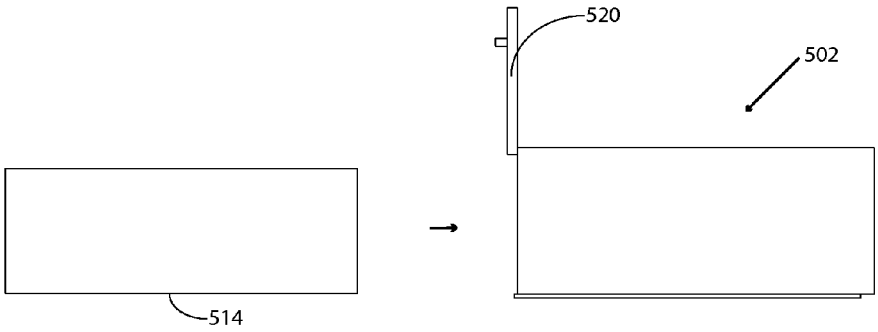
FIG. 5E schematically shows the cleaning material component of FIG. 5B being inserted into the cleaning material support component of the cleaning implement of FIG. 5A from a side view.
Figure 5F:
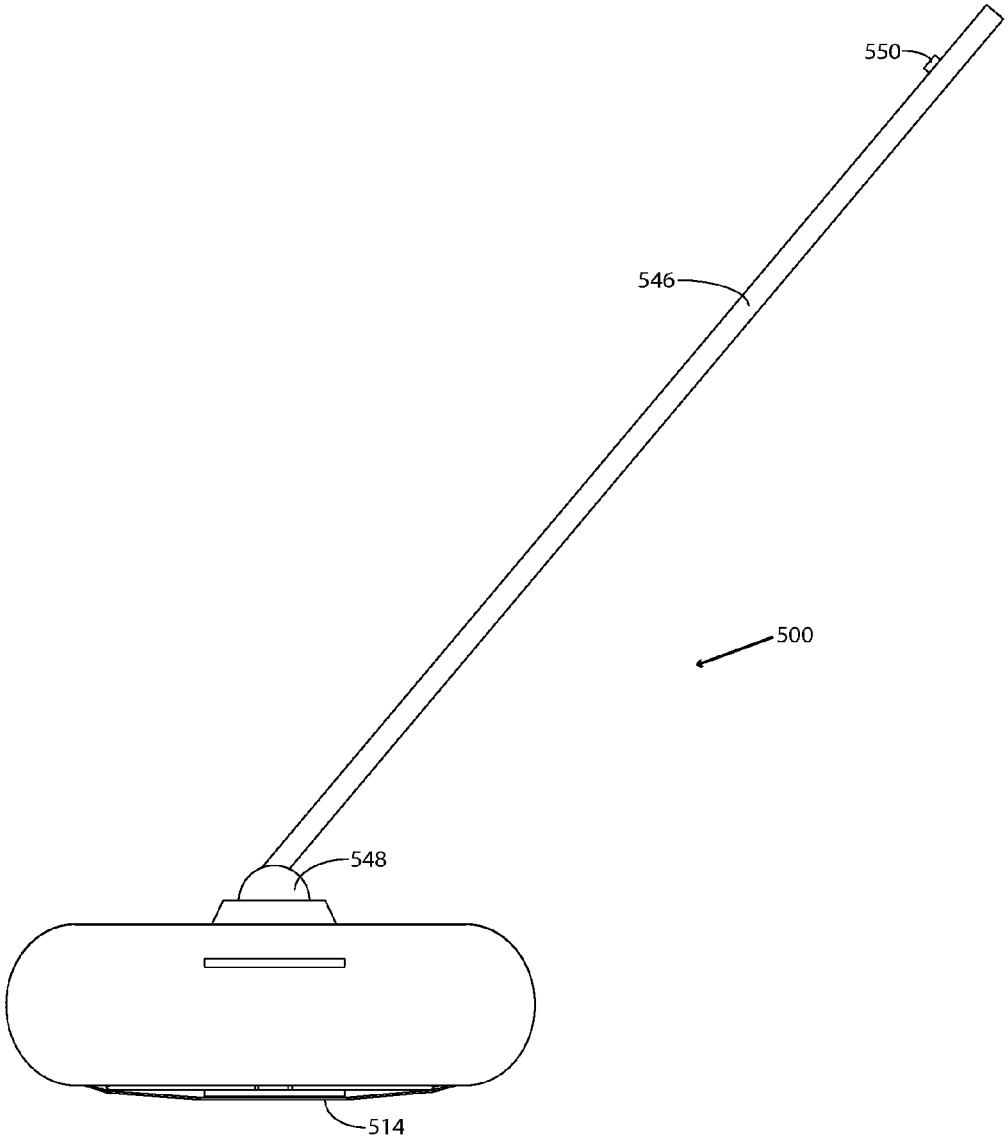
FIG. 5F schematically shows the cleaning implement of FIG. 5A with a handle from a front side view.

The cleaning implements of the invention typically include one or more handle components. As shown in FIG. 5F, for example, cleaning implement 500 includes handle 546 operably connected to head component 502. Handle 546 is pivotally connected to head component 502 via pivot mechanism 548 (shown as a ball and socket mechanism). As also shown, handle 546 includes switch 550 which is operably connected to the motor. Switch 550 is used to effect movement of cleaning material component 514 via the conveyance mechanism described above.

FIGS. 6 A and B schematically show a cleaning implement, a cleaning material component, or components thereof from various views according to some embodiment of the invention. As shown, cleaning implement 600 includes a head component that includes cleaning material support component 602 and cleaning surface component 604. Cleaning material support component 602 includes cleaning material support component surfaces 606 that at least partially define cleaning material receiving areas 608. As also shown, cleaning material support component 602 include openings 610 that are structured such that cleaning material receiving areas 608 communicate with cleaning surface component 604. As shown, cleaning material receiving areas 608 are configured to receive cleaning material component 612 (shown as a cleaning material roll) such that at least a portion of cleaning material component 612 is movable to and/or from cleaning material receiving areas 608 to extend over at least a portion of cleaning surface component 604.

Figure 6A:
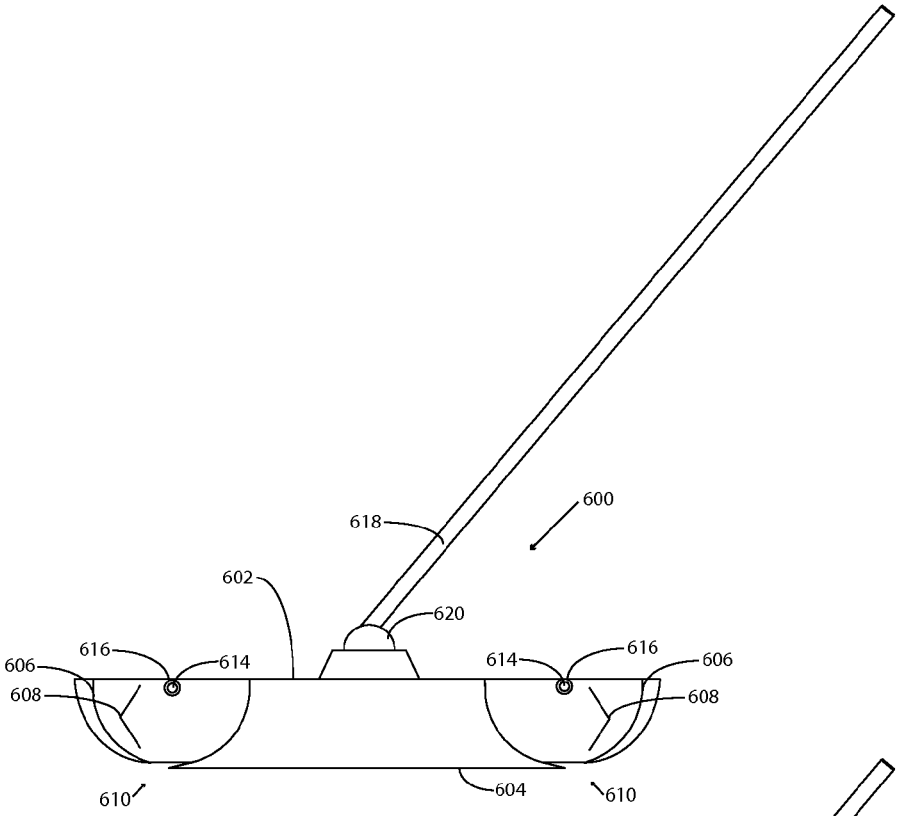
FIG. 6A schematically shows a cleaning implement from a side view in the absence of a cleaning material component disposed in cleaning material receiving areas of the cleaning implement.
Figure 6B:
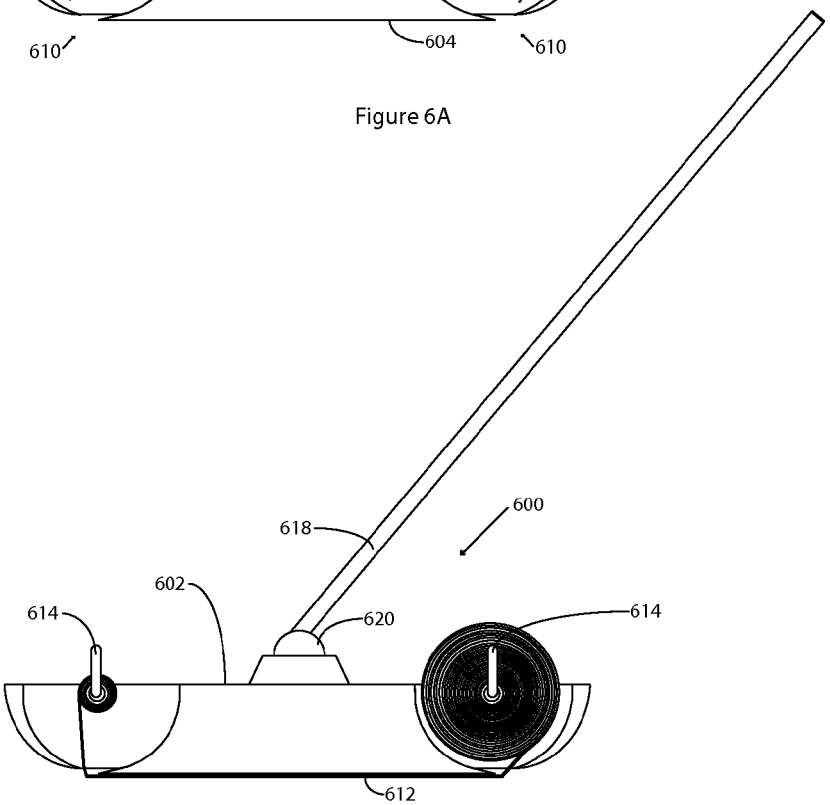
FIG. 6B schematically shows the cleaning implement of FIG. 6A from a side view with a cleaning material component disposed in cleaning material receiving areas of the cleaning implement.

In addition, cleaning implement 600 also includes retaining components 614 (shown as hinged pegs) coupled to alignment components 616 (shown as rods). In FIG. 6A, retaining components 614 are shown in open positions such that cleaning material component 612 can be placed in cleaning material receiving areas 608. The alignment components (rods 616) of cleaning material support component 602 insert into corresponding central receiving areas of the cleaning material roll (cleaning material 612) to align cleaning material 612 relative to cleaning material support component 602. In FIG. 6B, retaining components 614 are shown in closed positions such that cleaning material component 612 is retained in cleaning material receiving areas 608 during use. A user can selectively position desired portions of cleaning material 612 relative to cleaning surface component 604 (e.g., rolling a clean portion of cleaning material 612 into position over cleaning surface component 604 after another portion of cleaning material 612 has been soiled during use, etc.).

The cleaning implements of the invention typically include one or more handle components. As shown in FIGS. 6 A and B, for example, cleaning implement 600 includes handle component 618. Handle component 618 is pivotally connected to the head component via pivot mechanism 620 (shown as a ball and socket mechanism).

Figure 7A:
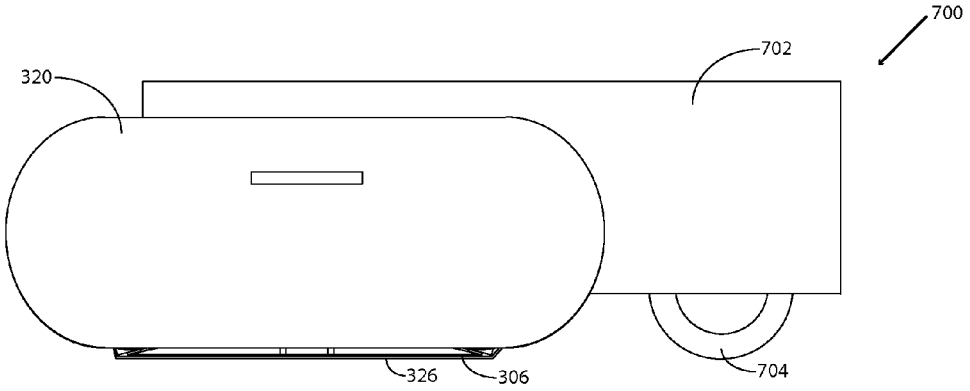
FIG. 7A schematically shows a robotic cleaning implement from a side view.
Figure 7B:
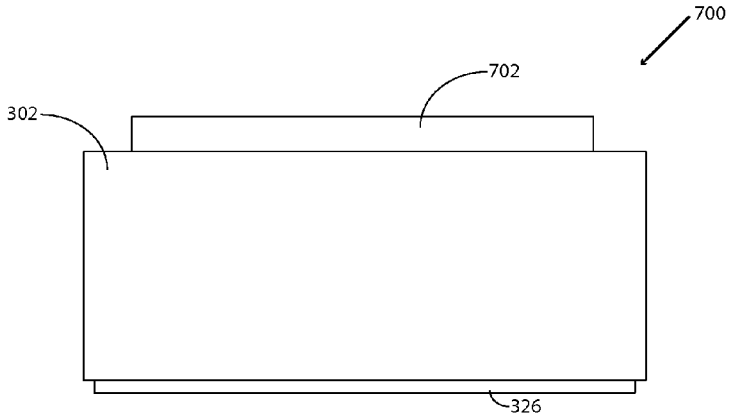
FIG. 7B schematically shows the robotic cleaning implement of FIG. 7A from a front side view.

FIGS. 7 A and B schematically depict a robotic cleaning implement from various views according to one exemplary embodiment of the invention. As shown, robotic cleaning implement 700 includes head component 302 (described further above) operably connected to robot body structure 702. Robot body structure 702 houses a drive system that causes movement of robotic cleaning implement 700, e.g., via wheels 704 (one wheel 704 not within view in FIG. 7A). Robot body structure 702 also includes a controller (e.g., a microcontroller, etc.) that controls movement robotic cleaning implement 700 and the conveyance mechanism of head component 302. In some embodiments, for example, the controller is operably connected to motor 343 and effects rotation (e.g., includes instructions, stored in a memory of the robot body structure, which when executed effects rotation, etc.) of cleaning material roll (cleaning material 326) (via gear components 340 and 341) selected distances such that cleaning material 326 is positioned at selected positions relative to cleaning surface component 306. In some embodiment, power source 347 is not included. In these embodiments, a power source is optionally included in the robot body structure and operably connected to, e.g., the drive system and motor 343. Typically, the robotic cleaning implements of the invention include one or more navigation sensors (e.g., as part of a global positioning system) operably connected to controllers of the implements. In certain embodiments, the head components of the robotic cleaning implements of the invention are detachable from robot body structures, e.g., so that different head components can be utilized with a given robot body structure.

The cleaning implements or components thereof of the invention are optionally adapted for use as part of various types of robotic cleaning implements. Exemplary robotic cleaners or aspect there of that are optionally adapted for use with these cleaning implements or components are described in, e.g., U.S. Pat. No. 7,571,511, entitled "Autonomous floor cleaning robot" to Jones et al, which issued Aug. 11, 2009; U.S. Pat. No. 7,620,476, entitled "Autonomous surface cleaning robot for dry cleaning" to Morse et al., which issued Nov. 17, 2009; U.S. Pat. No. 7,636,982, entitled "Autonomous floor cleaning robot" to Jones et al, which issued Dec. 29, 2009; and U.S. Pat. No. 7,761,954, entitled "Autonomous surface cleaning robot for wet and dry cleaning" to Ziegler et al., which issued Jul. 27, 2010; and U.S. Patent Application Publication Nos. US 2009/0281661, entitled "Application of localization, positioning & navigation systems for robotic enabled mobile products" by Dooley et al., which published Nov. 12, 2009 and US 2009/0306822, entitled "Multi-function robotic device" by Augenbraun et al., which published Dec. 10, 2009, which are each incorporated by reference herein in their entirety.

Cleaning implement and cleaning material components (e.g., head components, cleaning material support components, cleaning surface components, retaining components, retaining mechanisms, cleaning implement cartridges, cleaning materials, handles, conveyance mechanisms, fluid handling mechanisms, conduits, containers, nozzles, etc.) are optionally formed by various fabrication techniques or combinations of such techniques including, e.g., cast molding, stamping, machining, embossing, extrusion, engraving, injection molding, etching (e.g., electrochemical etching, etc.), or other techniques. These and other suitable fabrication techniques are generally known in the art and described in, e.g., Molinari et al. (Eds.), Metal Cutting and High Speed Machining, Kluwer Academic Publishers (2002), Altintas, Manufacturing Automation Metal Cutting Mechanics, Machine Tool Vibrations, and CNC Design, Cambridge University Press (2000), Stephenson et al., Metal Cutting Theory and Practice, Marcel Dekker (1997), Fundamentals of Injection Molding, W. J. T. Associates (2000), Whelan, Injection Molding of Thermoplastics Materials, Vol. 2, Chapman & Hall (1991), Rosato, Injection Molding Handbook, 3.sup.rd Ed., Kluwer Academic Publishers (2000), Fisher, Extrusion of Plastics, Halsted Press (1976), and Chung, Extrusion of Polymers: Theory and Practice, Hanser-Gardner Publications (2000), which are each incorporated by reference. Exemplary materials optionally used to fabricate device components include, e.g., metal, glass, wood, polymethylmethacrylate, polyethylene, polydimethylsiloxane, polyetheretherketone, polytetrafluoroethylene, polystyrene, polyvinylchloride, polypropylene, polysulfone, polymethylpentene, and polycarbonate, among many others. In certain embodiments, following fabrication, device components are optionally further processed, e.g., by painting, coating surfaces with a hydrophilic coating, a hydrophobic coating, or the like.

While the foregoing invention has been described in some detail for purposes of clarity and understanding, it will be clear to one skilled in the art from a reading of this disclosure that various changes in form and detail can be made without departing from the true scope of the invention. For example, all the techniques and apparatus described above can be used in various combinations. All publications, patents, patent applications, and/or other documents cited in this application are incorporated by reference in their entirety for all purposes to the same extent as if each individual publication, patent, patent application, and/or other document were individually indicated to be incorporated by reference for all purposes.

What is claimed is:

1. A cleaning implement, comprising at least one head component that comprises at least two cleaning material support components and at least one cleaning surface component, wherein the cleaning material support components each comprise at least one cleaning material support component surface that at least partially defines at least one cleaning implement cartridge receiving area, wherein the cleaning material support components each comprise at least one opening such that the cleaning implement cartridge receiving areas communicate with the cleaning surface component, and wherein the cleaning implement cartridge receiving areas of the cleaning material support components are configured to receive at least a component of at least one cleaning implement cartridge comprising cleaning material such that at least a portion of the cleaning material is movable to and/or from the cleaning implement cartridge receiving areas to extend over at least a portion of the cleaning surface component when the cleaning implement cartridge is at least partially disposed in the cleaning implement cartridge receiving areas.

2. The cleaning implement of claim 1, comprising an operably connected robot body structure.

3. The cleaning implement of claim 1, comprising at least one positioning mechanism component that is configured to selectively position the cleaning material at least relative to at least one of the cleaning material support components when at least the portion of the cleaning implement cartridge is at least partially disposed in the cleaning implement cartridge receiving areas.

4. The cleaning implement of claim 1, comprising at least one retaining component that is configured to substantially retain the cleaning implement cartridge at a selected position relative to at least one of the cleaning material support components when at least the portion of the cleaning implement cartridge is at least partially disposed in the cleaning implement cartridge receiving areas.

5. The cleaning implement of claim 1, comprising at least one retaining mechanism that is configured to substantially retain the cleaning material at a selected position relative to the cleaning surface component when at least the portion of the cleaning implement cartridge is at least partially disposed in the cleaning implement cartridge receiving areas and the cleaning material extends over at least the portion of the cleaning surface component.

6. The cleaning implement of claim 1, comprising at least the portion of the cleaning implement cartridge at least partially disposed in the cleaning implement cartridge receiving areas of the cleaning material support components.

7. The cleaning implement of claim 1, wherein the cleaning surface component comprises at least one elevational element.

8. The cleaning implement of claim 1, comprising at least one handle operably connected to the head component.

9. The cleaning implement of claim 8, wherein the handle is pivotally connected to the head component via at least one pivot mechanism.

10. The cleaning implement of claim 1, comprising at least one conveyance mechanism, or at least one component thereof, that is configured to convey at least the cleaning material over at least a portion of the cleaning surface component when at least the portion of the cleaning implement cartridge is at least partially disposed in the cleaning implement cartridge receiving areas.

11. The cleaning implement of claim 10, wherein the conveyance mechanism is manually operated via at least one manual conveyance component.

12. The cleaning implement of claim 10, wherein the conveyance mechanism or the component thereof is configured to operably engage the cleaning implement cartridge to effect conveyance of the cleaning material when at least the portion of the cleaning implement cartridge is at least partially disposed in the cleaning implement cartridge receiving areas.

13. The cleaning implement of claim 10, wherein the conveyance mechanism is configured to convey the cleaning material at least one selected incremental distance.

14. The cleaning implement of claim 10, wherein the conveyance mechanism comprises one or more gear components.

15. The cleaning implement of claim 10, wherein the conveyance mechanism comprises at least one motor component that is configured to effect conveyance of the cleaning material when at least the portion of the cleaning implement cartridge is at least partially disposed in the cleaning implement cartridge receiving areas.

16. The cleaning implement of claim 10, comprising at least one fluid handling mechanism or at least one component thereof that is configured to convey at least one fluid from at least one fluid source to at least one fluid outlet.

17. The cleaning implement of claim 16, wherein the fluid outlet communicates with the cleaning implement cartridge or a portion thereof when at least the portion of the cleaning implement cartridge is at least partially disposed in the cleaning implement cartridge receiving areas.

18. The cleaning implement of claim 16, wherein the fluid outlet is disposed proximal to at least one surface of the head component.

19. The cleaning implement of claim 16, wherein the fluid outlet comprises at least one nozzle.

20. The cleaning implement of claim 16, wherein the fluid handling mechanism comprises at least one pumping mechanism that is configured to pump the fluid from the fluid source to the fluid outlet.

21. The cleaning implement of claim 16, wherein the fluid handling mechanism comprises at least one vaporization component that is configured to vaporize the fluid at least proximal to the fluid outlet.

22. The cleaning implement of claim 16, wherein the fluid source and fluid outlet communicate via at least one fluid conduit.

23. The cleaning implement of claim 16, wherein the fluid source comprises at least one fluid container.

24. The cleaning implement of claim 23, wherein the fluid container is removable.

25. A cleaning implement cartridge, comprising at least two housings and at least one cleaning material, wherein each housing comprises at least one housing surface that at least partially defines a cavity, wherein each housing comprises at least one orifice that communicates with the cavity, wherein the cleaning material is at least partially disposed in the cavity of each housing such that the cleaning material is movable to and/or from each housing, wherein at least a portion of each housing is configured to be received in a cleaning implement cartridge receiving area of a cleaning implement, and wherein the cleaning material is configured to extend over at least a portion of a cleaning surface component of the cleaning implement when each housing is at least partially disposed in the cleaning implement cartridge receiving area of the cleaning implement.

26. The cleaning implement cartridge of claim 25, comprising at east one conveyance mechanism or at least one component thereof.

27. The cleaning implement cartridge of claim 25, wherein the cleaning material is moistened with at least one fluid.

28. The cleaning implement cartridge of claim 25, comprising at least one positioning mechanism component that is configured to selectively position the cleaning material relative to the housings and/or the cleaning implement.

29. The cleaning implement cartridge of claim 25, wherein the housings and/or the cleaning material comprises at least one alignment component that is configured to align the cleaning material relative to the housings.

30. The cleaning implement cartridge of claim 25, wherein each housing comprises at least one alignment feature that is structured to align the housing and the cleaning implement relative to one another when the housing is at least partially disposed in the cleaning implement cartridge receiving area of the cleaning implement.

31. The cleaning implement cartridge of claim 25, wherein the cleaning material comprises at least one absorbent material.

32. The cleaning implement cartridge of claim 25, wherein the cleaning material comprises at least one cleaning material sheet.

33. The cleaning implement cartridge of claim 32, wherein the cleaning material sheet is at least partially segmented.

34. The cleaning implement cartridge of claim 32, wherein the cleaning material sheet is substantially continuous.

35. The cleaning implement cartridge of claim 25, wherein the cleaning material comprises at least one cleaning material roll.

36. The cleaning implement cartridge of claim 35, wherein the cleaning material roll is at least partially segmented.

37. The cleaning implement cartridge of claim 35, wherein the cleaning material roll is substantially continuous.

38. The cleaning implement cartridge of claim 35, wherein the housings and/or cleaning material roll comprises at least one alignment component that is configured to align the cleaning material roll relative to the housings.

39. The cleaning implement cartridge of claim 38, wherein the alignment component comprises a rod that extends at least partially within the cavity.

40. The cleaning implement cartridge of claim 39, wherein the rod and/or the cleaning material roll comprises at least one positioning component that is configured to position the rod and the cleaning material roll relative to one another.

41. The cleaning implement cartridge of claim 39, wherein the rod extends through at least a portion of at least one of the housings and operably connects, or is operably connectable, to at least one conveyance mechanism or at least one component thereof.

42. The cleaning implement cartridge of claim 39, wherein the cleaning material roll is configured to rotate in a substantially fixed position relative to the rod.

43. A cleaning implement, comprising at least one head component that comprises at least one cleaning material support component and at least one cleaning surface component, wherein the cleaning material support component comprises at least one cleaning material support component surface that at least partially defines at least one cleaning implement cartridge receiving area, wherein the cleaning material support component comprises at least one opening such that the cleaning implement cartridge receiving area communicates with the cleaning surface component, and wherein the cleaning implement cartridge receiving area is configured to receive at least one cleaning implement cartridge comprising cleaning material such that at least a portion of the cleaning material is movable to and/or from the cleaning implement cartridge receiving area to extend over at least a portion of the cleaning surface component when the cleaning implement cartridge is at least partially disposed in the cleaning implement cartridge receiving area, and wherein the cleaning implement comprises at least one conveyance mechanism, or at least one component thereof, that is configured to convey at least the cleaning material over at least the portion of the cleaning surface component when the cleaning implement cartridge is at least partially disposed in the cleaning implement cartridge receiving area.

44. The cleaning implement of claim 43, comprising an operably connected robot body structure.

45. The cleaning of claim 43, comprising at least one positioning mechanism component that is configured to selectively position the cleaning material at least relative to the cleaning material support component when the cleaning implement cartridge is at least partially disposed in the cleaning implement cartridge receiving area.

46. The cleaning implement of claim 43, comprising at least two cleaning material support components that are each configured to receive at least a component of the cleaning implement cartridge.

47. The cleaning implement of claim 43, comprising at least one retaining component that is configured to substantially retain the cleaning implement cartridge at a selected position relative to the cleaning material support component when the cleaning implement cartridge is at least partially disposed in the cleaning implement cartridge receiving area.

48. The cleaning implement of claim 43, comprising at least one retaining mechanism that is configured to substantially retain the cleaning material at a selected position relative to the cleaning surface component when the cleaning implement cartridge is at least partially disposed in the cleaning implement cartridge receiving area and the cleaning material extends over at least the portion of the cleaning surface component.

49. The cleaning implement of claim 43, comprising the cleaning implement cartridge at least partially disposed in the cleaning implement cartridge receiving area of the cleaning material support component.

50. The cleaning implement of claim 43, wherein the cleaning surface component comprises at least one elevational element.

51. The cleaning implement of claim 43, comprising at least one handle operably connected to the head component.

52. The cleaning implement of claim 51, wherein the handle is pivotally connected to the head component via at least one pivot mechanism.

53. The cleaning implement of claim 43, wherein the conveyance mechanism is manually operated via at least one manual conveyance component.

54. The cleaning implement of claim 43, wherein the conveyance mechanism or the component thereof is configured to operably engage the cleaning implement cartridge to effect conveyance of the cleaning material when the cleaning implement cartridge is at least partially disposed in the cleaning implement cartridge receiving area.

55. The cleaning implement of claim 43, wherein the conveyance mechanism is configured to convey the cleaning material at least one selected incremental distance.

56. The cleaning implement of claim 43, wherein the conveyance mechanism comprises one or more gear components.

57. The cleaning implement of claim 43, wherein the conveyance mechanism comprises at least one motor component that is configured to effect conveyance of the cleaning material when the cleaning implement cartridge is at least partially disposed in the cleaning implement cartridge receiving area.

58. The cleaning implement of claim 43, comprising at least one fluid handling mechanism or at least one component thereof that is configure to convey at least one fluid from at least one fluid source to at least one fluid outlet.

59. The cleaning implement of claim 58, wherein the fluid outlet communicates with the cleaning implement cartridge or a portion thereof when the cleaning implement cartridge is at least partially disposed in the cleaning implement cartridge receiving area.

60. The cleaning implement of claim 58, wherein the fluid outlet is disposed proximal to at least one surface of the head component.

61. The cleaning of claim 58, wherein the fluid outlet comprises at least one nozzle.

62. The cleaning implement of claim 58, wherein the fluid handling mechanism comprises at least one pumping mechanism that is configured to the pump fluid from the fluid source to the fluid outlet.

63. The cleaning implement of claim 58, wherein the fluid handling mechanism comprises at least one vaporization component that is configured to vaporize the fluid at least proximal to the fluid outlet.

64. The cleaning implement of claim 58, wherein the fluid source and fluid outlet communicate via at least one fluid conduit.

65. The cleaning implement of claim 58, wherein the fluid source comprises at least one fluid container.

66. The cleaning implement of claim 58, wherein the fluid container is removable.

67. A cleaning implement cartridge, comprising at least one housing and at least one cleaning material, wherein the housing comprises at least one housing surface that at least partially defines a cavity, wherein the housing comprises at least one orifice that communicates with the cavity, wherein the cleaning material is at least partially disposed in the cavity such that the cleaning material is movable to and/or from the housing, wherein at least a portion of the housing is configured to be received in a cleaning implement cartridge receiving area of a cleaning implement, wherein the cleaning material is configured to extend over at least a portion of a cleaning surface component of the cleaning implement when the housing is at least partially disposed in the cleaning implement cartridge receiving area of the cleaning implement, wherein the cleaning material comprises at least one cleaning material roll, wherein the housing and/or cleaning material roll comprises at least one alignment component that is configured to align the cleaning material roll relative to the housing, wherein the alignment component comprises a rod that extends at least partially within the cavity, and wherein the rod extends through at least a portion of the housing and operably connects, or is operably connectable, to at least one conveyance mechanism at least one component thereof.

* * * * *

UNITED STATES PATENT AND TRADEMARK OFFICE

CERTIFICATE OF CORRECTION

PATENT NO. : 8,662,781 B2
APPLICATION NO. : 13/072656
DATED : March 4, 2014
INVENTOR(S) : Christopher C. Sappenfield It is certified that error appears in the above-identified patent and that said Letters Patent is hereby corrected as shown below:

In the Claims:

Column 23, line 60 in claim 26,
at east one conveyance mechanism
when in fact the phrase should read:
at least one conveyance mechanism Column 25, line 6 in claim 45,
The cleaning of claim 43,
when in fact the phrase should read:
The cleaning implement of claim 43, Column 26, line 6 in claim 58,
that is configure to convey
when in fact the phrase should read:
that is configured to convey Column 26, line 16 in claim 61,
The cleaning of claim 58,
when in fact the phrase should read:
The cleaning implement of claim 58, Column 26, line 55 in claim 67,
conveyance mechanism at least one component thereof.
when in fact the phrase should read:
conveyance mechanism or at least one component thereof.

Signed and Sealed this
Twenty-seventh Day of May, 2014

Michelle K. Lee

Michelle K. Lee
*Deputy Director of the United States Patent and Trademark Office*